US011489257B2

(12) United States Patent
Sadri et al.

(10) Patent No.: US 11,489,257 B2
(45) Date of Patent: Nov. 1, 2022

(54) HIGH PERFORMANCE LENS ANTENNA SYSTEMS

(71) Applicant: Intel Corporation, Santa Clara, CA (US)

(72) Inventors: Ali Sadri, San Diego, CA (US); Debabani Choudhury, Thousand Oaks, CA (US); Bradley Jackson, Hillsboro, OR (US); Shengbo Xu, Newark, CA (US); Tae Young Yang, Portland, OR (US); Zhen Zhou, Chandler, AZ (US); Cheng-Yuan Chin, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 17/335,301

(22) Filed: Jun. 1, 2021

(65) Prior Publication Data

US 2022/0021115 A1 Jan. 20, 2022

Related U.S. Application Data

(62) Division of application No. 16/399,451, filed on Apr. 30, 2019, now Pat. No. 11,043,743.

(51) Int. Cl.

| | |
|---|---|
| ***H01Q 3/44*** | (2006.01) |
| ***H01Q 19/06*** | (2006.01) |
| ***H01Q 21/06*** | (2006.01) |

(52) U.S. Cl.

CPC ..... *H01Q 3/44* (2013.01); *H01Q 19/062* (2013.01); *H01Q 21/06* (2013.01)

(58) Field of Classification Search

CPC ..... H01Q 3/44; H01Q 19/06; H01Q 19/062; H01Q 19/17; H01Q 19/195; H01Q 21/06; H01Q 25/00

See application file for complete search history.

(56) References Cited

U.S. PATENT DOCUMENTS 3,521,284 A 7/1970 Shelton et al.
9,735,822 B1 8/2017 Kuo
(Continued)

FOREIGN PATENT DOCUMENTS

WO WO-2017/179654 A1 10/2017

OTHER PUBLICATIONS

Search Report and Written Opinion dated Jul. 24, 2020 for International Application No. PCT/US2020/016009.
(Continued)

*Primary Examiner* — Jimmy T Vu
(74) *Attorney, Agent, or Firm* — Banner & Witcoff Ltd.

(57) ABSTRACT

A lens antenna system is disclosed. The lens antenna system comprises a hybrid focal source antenna circuit configured to generate a source antenna beam for integration with different lens structures. In some embodiments, the hybrid focal source antenna circuit comprises a set of antenna elements coupled to one another. In some embodiments, the set of antenna elements comprises a first antenna element configured to be excited in a first spherical mode; and a second antenna element configured to be excited in a second, different, spherical mode. In some embodiments, the first spherical mode and the second spherical mode are co-polarized. In some embodiments, the lens antenna system further comprises a lens configured to shape the source antenna beam associated with the hybrid focal source antenna circuit, in order to provide an output antenna beam.

20 Claims, 40 Drawing Sheets

(56) References Cited

U.S. PATENT DOCUMENTS

| | | | | |
|---|---|---|---|---|
| 10,418,716 | B2 * | 9/2019 | Zimmerman | H01Q 19/062 |
| 2009/0315794 | A1 | 12/2009 | Alamouti et al. | |
| 2017/0271750 | A1 | 9/2017 | Harris et al. | |
| 2019/0027823 | A1 | 1/2019 | Matitsine et al. | |
| 2020/0083602 | A1 | 3/2020 | Sethumadhavan et al. | |

OTHER PUBLICATIONS

Antenna Fundamentals. Mti Wireless Edge Ltd. Antenna Fundamentals. https://www.mtiwe.com/?CategoryID=353&ArticleID=163. 16 pages.

"RF Signal Analyzers—Configure Your System Now, Perform Demodulation and 1/Q Signal Acquisition wit~1 NI RF Singal Analysers. ni.corn." Antenna Theory—Lens. tutorialspoint simply easy learning. https://www.tutorialspoint.com/ntenna_theory/antenna_theory_lens.htm. 4 pages.

"Chapter 4 Collimation." Integrated Publishing, Inc. http://firecontrolman.tpub.com/14101/css/Chapter-4-Collimation-81. D htm. 3 pages.

"Null (radio)". Wikipedia. httpsi/en.wikipedia.org/wiki/Nuil_(radio). 1 page.

"Waveguide Modes TE, TM, TEM . . . Signals propagate within waveguides in a number of different ways or modes: TE, TM and they have different orders of each mode . . . " Electronic Notes, Incorporating Radio-Electronics.com.https://www.electronics-notes.com/articles/antennas-propagation/rf-feeders-transmission-lines/waveguide-modes-te-tm-tem.php. 3 pages.

What is a Lens Antenna? Editorial Team—everything RF. Sep. 19, 2018. https://www.everythingrf.com/community/what-is-a-lens-antenna. 6 pages.

"Lens Antenna." Wikipedia. https://en.wikipedia.org/wiki/Lens_antenna. 1 page.

Yang, Taeyoung et al. "Minimum Radiation-Q of Polarized Antennas with Various Source Configurations." 2009 IEEE. 4 pages.

Yang, Taeyoung et al. "A Direct Matrix Approach to 3-D Antenna Radiation-Pattern Estimation from Partially-Scanned Spherical Near-Field Data." 2011 IEEE. 4 pages.

Liang, Min et al. "A 3-D Luneburg Lens Antenna Fabricated by Polymer Jetting Rapid Prototyping." IEEE Transactions on Antennas and Propagation, vol. 62, No. 4, Apr. 2014. 9 pages.

Minatti, Gabriele et al. "Synthesis of Moduiated-Metasurface Antennas With Amplitude, Phase, and Polarization ControL" IEEE Transactions on Antennas and Propagation, vol. 64, No. 9, Sep. 2016. 13 pages.

Saleem, M. Kamran et al., "Lens Antenna for Wide Angle Beam Scanning at 79 GHz for Automotive Short Range Radar Applications." IEEE Transactions on Antennas and Propagation, vol. 65, No. 4, Apr. 2017, 6 pages.

Kubach, A. et al., "3D Printed Luneburg Lens for Flwsible Beam Steering at Millimeter Wave Frequencies," Proceedings of the 47th European Microwave Conference, Oct. 10-12, 2017, Nuremberg, Germany, 4 pages.

Numan, Ahmed B. et al., "Printed W-Band Multibeam Antenna with Luneburg Lens-Based Beamforming Network," IEEE Transactions on Antennas and Prpagation, vol. 66, No. 10, Oct. 2018, 6 pages.

Lamminen, Antti Eino Llmari et al. "Beam-Switching Dual-Spherical Lens Antenna With Low Scan Loss at 71-76 GHz." IEEE Antennas and Wireless Propagation Letters, vol. 17, No. 10, Oct. 2018, 5 pages.

Wang, Ren et al., "Wide-angle scanning planar array with quasi-hemispherical-pattern elements," Scientific Reports, www.nature.com/scientificreports, Jun. 2, 2017, 14 pages.

Skolnik, Merril I., "Introduction to Radar Systems," 590 pages.

Chapter 5 Dielectric waveguides, 49 pages.

Jensen Frank et al., "On the numnber of Modes in Sperical Wave Expansions," 26th AMTA, Stone Mount Park, GA, Oct. 17-22, 6 pages.

Design of TE11 Mode Launcher in Circular Waveguide in S-Band., ResearchGate, Conference Paper: Mar. 2017, 4 pages.

* cited by examiner

3500

3504 3506 3502 3510

| Lens Model | Hor. scan angle ($deg_E$) | Ver. scan angle ($deg_E$) | Hor. 3dB BW ($deg_E$) @ Beam $\beta$ | Ver. 3dB BW ($deg_E$) @ Beam $\gamma$ | Hor. FoV ($deg_E$) | Ver. FoV ($deg_E$) | Gain Enhancement (dB) @ Beam $\alpha$ |
|---|---|---|---|---|---|---|---|
| 5067α | ±17 | ±4.5 | 3.4 | 5.8 | 37.4 | 14.8 | 7.06 |
| 5067 | ±17 | ±4.5 | 3.5 | 7 | 37.5 | 16 | 8.50 |
| 6060 | ±13.5 | ±7 | 2.9 | 6.4 | 29.9 | 20.4 | 7.93 |
| 7090 | ±10 | ±1 | 2.4 | 3.7 | 22.4 | 5.7 | 12.52 |
| RFEM only | ±49 | ±19.5 | 22 | 49.3 | 120 | 88.3 | 0 |

FIG. 35

HIGH PERFORMANCE LENS ANTENNA SYSTEMS

CROSS-REFERENCE TO RELATED APPLICATIONS

The present application is a divisional application of U.S. patent application Ser. No. 16/399,451, filed on Apr. 30, 2019, the contents of each of which are incorporated herein by reference in their entirety.

FIELD

The present disclosure relates to lens antenna systems, and in particular, to systems and methods for realizing high performance lens antenna systems.

BACKGROUND

There is a strong demand in the market for a low-cost, robust solution enabling a highly-directive beam in RF and millimeter-wave (mmW) domain. Emerging technologies, including 5G-and-beyond wireless-communication infrastructures, connected autonomous vehicles, radar sensors and CubeSat networks can benefit from a highly directive beam. Highly directive beam offers an efficient data-delivery route to a particular user, reduces interference between nearby users, and helps to extend communication range. The highly-directive beam enables high-resolution radar imaging and wireless sensing capabilities for autonomous vehicle applications. Physical size of the application platforms is large enough, compared to the wavelength of mmW frequency range. Thus, performance and cost of highly-directive beam solution have been often emphasized rather than the size of the solution. RF/mmW, analog, digital, hybrid (analog+digital) beamforming techniques have been popular by using a mmW phased array antenna (PAA) system. Beamforming in RF/mmW domain is preferred because digital and hybrid beamforming techniques are potentially vulnerable to jamming signals and unintended strong adjacent interferences. However, hardware complexity, calibration difficulty, implementation and maintenance increase rapidly as the number of elements in PAA systems increases in order to achieve a highly-directive beam. In addition, insertion loss of mmW PAA feed network noticeably increases as the size of PAA increases.

BRIEF DESCRIPTION OF THE DRAWINGS

Some examples of circuits, apparatuses and/or methods will be described in the following by way of example only. In this context, reference will be made to the accompanying Figures.

FIG. 35 illustrates a table that depicts a trade-off between gain enhancement and maximum scan angle associated with a lens antenna system, according to one embodiment of the disclosure.

DETAILED DESCRIPTION

Figure 1:
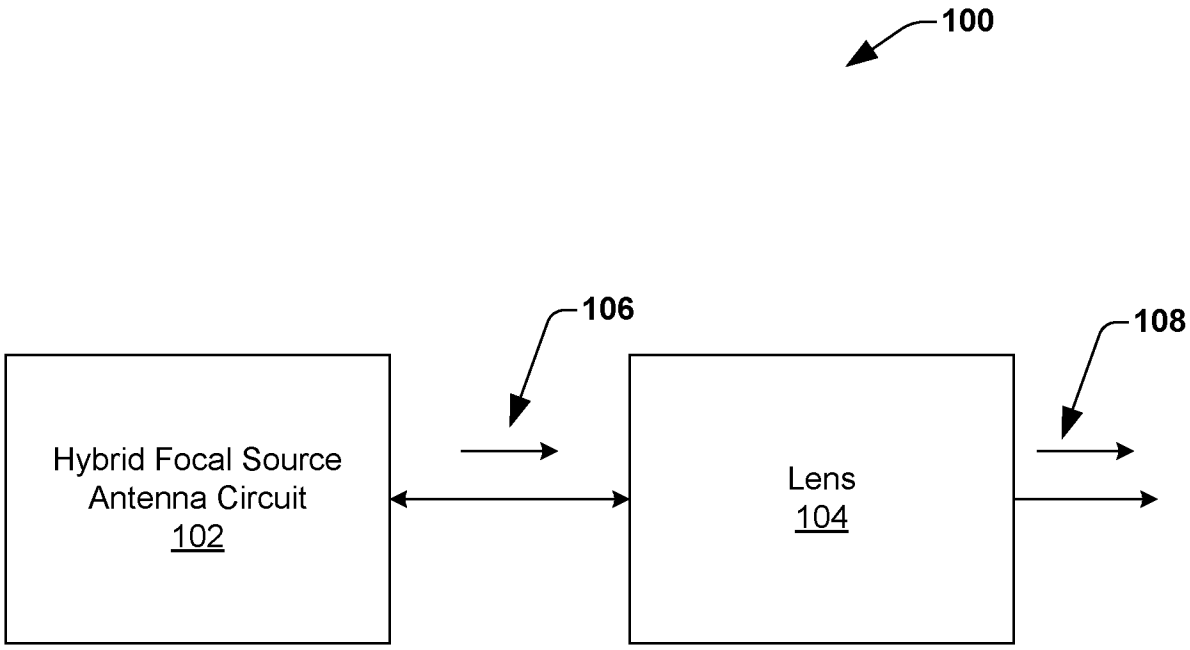
FIG. 1 illustrates a simplified block diagram of an exemplary lens antenna system comprising a hybrid focal source antenna circuit, according to one embodiment of the disclosure.

In one embodiment of the disclosure, a lens antenna system is disclosed. The lens antenna system comprises a hybrid focal source antenna circuit configured to generate a source antenna beam. In some embodiments, the hybrid focal source antenna circuit comprises a set of antenna elements coupled to one another. In some embodiments, the set of antenna elements comprises a first antenna element configured to be excited in a first spherical mode; and a second antenna element configured to be excited in a second, different, spherical mode. In some embodiments, the first spherical mode and the second spherical mode are co-polarized.

In one embodiment of the disclosure, a cascaded lens system associated with a lens antenna system is disclosed. In some embodiments, the cascaded lens system comprises a focusing lens configured to receive a collimated beam associated with a source antenna circuit and focus the collimated beam, in order to convert the collimated beam from spatial domain to spatial frequency domain, thereby forming a focused beam associated with the focusing lens. In some embodiments, the cascaded lens system further comprises a collimation lens configured to couple to the focused beam and collimate a select spatial frequency component associated with the focused beam, thereby forming a real collimated beam.

In one embodiment of the disclosure, a lens antenna system is disclosed. The lens antenna system comprises a waveguide array comprising a set of waveguides, wherein each of the set of waveguides is configured to convey electromagnetic waves associated with any communication and/or radar system. In some embodiments, the lens antenna system further comprises a lens coupled with the set of waveguides and configured to receive the electromagnetic waves associated with one or more waveguides of the set of waveguides, in order to provide one or more output antenna beams.

In one embodiment of the disclosure, a lens antenna system is disclosed. In some embodiments, the lens antenna system comprises a lens configured to receive an antenna source beam associated with an antenna source circuit and provide an output beam based on the received antenna source beam. In some embodiments, the lens is configured to provide a phase compensation to the received antenna source beam in accordance with a phase compensation profile associated with the lens, prior to providing the output beam. In some embodiments, the phase compensation profile of the lens is configured in a way that the lens provides 2-dimensional (2D) beam steering.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," "circuit" and the like are intended to refer to a computer-related entity, hardware, software (e.g., in execution), and/or firmware. For example, a component can be a processor (e.g., a microprocessor, a controller, or other processing device), a process running on a processor, a controller, an object, an executable, a program, a storage device, a computer, a tablet PC and/or a user equipment (e.g., mobile phone, etc.) with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the event that the terms "including", "includes", "having", "has", "with", or variants thereof are used in either the detailed description and the claims, such terms are intended to be inclusive in a manner similar to the term "comprising."

The following detailed description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of various embodiments. However, it will be apparent to those skilled in the art having the benefit of the present disclosure that the various aspects of the various embodiments may be practiced in other examples that depart from these specific details. In certain instances, descriptions of well-known devices, circuits, and methods are omitted so as not to obscure the description of the various embodiments with unnecessary detail.

As indicated above, emerging technologies, including 5G-and-beyond wireless-communication base stations and connected autonomous vehicles, can benefit from a highly directive beam. Phased array antenna (PAA) coherently combines waves from element antennas at far-field region to achieve narrow angular electromagnetic (EM) radiation. Unfortunately, hardware complexities, calibration difficulties as well as implementation and maintenance cost increase rapidly with more antenna array elements. As operational frequencies of the emerging applications move toward higher frequencies, millimeter-wave (mmW) and THz lens recently gets more attention as an alternative solution to enable a narrow beam due to advantages including narrow beams, multi-beams, light weight, wide frequency band, wide angle scanning, straightforward beam-broadening, compact size, and passive component. Employing lenses can significantly reduce hardware complexity and cost while it offers similar performance/capabilities to large-size phased array. In addition, mmW and THz lens with different characteristics can be placed on top or applied to an existing mmW/THz RFIC transceiver which has a fixed antenna array in the chip package, and address various applications with a minimum lead time. Compared to that, current phased array solution integrated in the RFIC package takes time to re-spin the package and array design. The lens antenna systems include a focal source antenna circuit configured to provide a source antenna beam and a lens system comprising a lens configured to provide an output antenna beam based on the source antenna beam. In the embodiments described throughout the disclosure, the term "focal source antenna circuit" is used interchangeably with the terms "source antenna circuit" and "antenna source circuit".

In order to have narrower beam output from the lens, wider beam from focal source antenna is preferred because lens acts like Fourier transform engine. However, there are challenges in addressing trade-offs in beam width and side-lobe level. For example, a wider beam focal source antenna typically results in narrower beam through a lens, yet a higher side-lobe level. Back-lobe level control is another challenge. Similarly, a narrower-beam focal source antenna results in a lower side-lobe-level beam through a lens, yet a wider main beam. In current implementations, lens performance is optimized through electromagnetic simulations for a given focal source antenna. However, as electrical size of lens gets bigger to obtain a narrower beam, the required computer resource and time increases rapidly and significantly. Alternatively, in some embodiments, the focal source antenna is designed for a given lens to address the trade-off. However, in such embodiments, there is no enough design degree of freedom for typical broad-beam element antennas to control the side-lobe level unless the beam is synthesized through a large-size antenna array. Small form-factor focal-source element antenna is preferred for enabling MIMO communication and radar applications.

In order to overcome the above disadvantages, a lens antenna system comprising a hybrid focal source antenna circuit is proposed in this disclosure. In particular, a hybrid focal source antenna circuit comprising a set of antenna elements configured to be excited in a respective set of co-polarized spherical modes, is proposed herein. In some embodiments, spherical modes comprise transverse magnetic (TM) modes and transverse electric (TE) modes. In some embodiments, the hybrid focal source antenna circuit offers increased design degree of freedom and addresses trade-off in beam width and side-lobe level.

In current implementations of lens antenna systems, the lens systems employ a single lens approach, in order to achieve a highly directive beam. However, the achievable directivity improvement with single lens is limited because the designs are often targeted for collimation purpose. In mmW systems, design of an antenna that emits pure fundamental mode (to be converted to an ideal plane wave—to form a highly directive beam) is extremely difficult. Therefore, in order to achieve a highly directive beam, in another embodiment of this disclosure, a lens antenna system comprising a cascaded lensing system is proposed. In some embodiments, cascaded lensing system uses multiple lenses to achieve quasi-collimation, focusing and real collimation of feed-antenna EM-radiation pattern, along with direct or indirect spatial filtering implemented in the Fourier imaging plane to alter the structure of EM radiation process, resulting in the generation of a highly directive radiation profile. In some embodiments, one or more lenses associated with the cascaded lens system may be integrated together.

At millimeter wave frequency, in some embodiments, path loss can be significant depending on the signal propagating path and the surrounding environment. Path loss degrades the signal to noise ratio (SNR) of a wireless system and hence detrimentally impacts the system performance. For example, low SNR reduces the maximum detection range and increases false alarm probability of a radar system, while decreasing the capacity of a communication system. To combat the SNR degradation caused by the path loss, in current implementations of lens systems, a lens with an array of feeding antennas is utilized to enhance the antenna gain and hence SNR. However, the antenna array suffers from an appreciable metallic loss at a millimeter wave frequency. Besides, the excitation of the surface waves due to the antenna array's finite ground plane reduces the antenna efficiency and directivity as well as causing gain non-uniformity across the elements. In some embodiments, an electromagnetic band gap or similar structure is presented to manage the interference among elements, which further complicates the antenna array design and potentially overshadow the benefit offered by the planar feeding antenna array for lens.

In order to overcome the above disadvantages, in another embodiment of the disclosure, a lens antenna system comprising a waveguide array comprising a plurality of waveguides coupled to a lens is proposed, further details of which are given in an embodiment below. In some embodiments, the plurality of waveguides comprises a plurality of dielectric waveguides made of dielectric material. In some embodiments, the proposed lens antenna system enables to mitigate the coupling among feeding array elements without introducing lens antenna fabrication and assembly complexity, ameliorate the aberration in collimation principally due to non-ideal lens-feeding antenna, and eliminate surface waves of the conventional feeding antennas.

In some embodiments, the lens associated with a lens antenna system offers a convenient and passive way to enhance the transmission distance of the focal source antenna circuit, without any additional active components and power. In some embodiments, the lens is an auxiliary device that enhances the gain while cooperating with the focal source antenna circuit after installation. However, existing implementations of lens antenna systems do not support 2D beam steering. In other words, in existing implementations of the lens antenna systems, the lens always steers the beam associated with the focal source antenna circuit in the same direction, irrespective of the beam steering direction of the focal source antenna circuit. In order to overcome the above disadvantage, a lens antenna system comprising a lens that supports 2D beam steering is proposed in this disclosure. In some embodiments, a phase compensation profile associated with the lens is adjusted, in order to achieve the 2D beam steering, further details of which are given in an embodiment below.

FIG. 1 illustrates a simplified block diagram of an exemplary lens antenna system 100, according to one embodiment of the disclosure. In some embodiments, the lens antenna system 100 may be part of wireless communication systems, for example, mmW systems. Further, in some embodiments, the lens antenna system 100 may be part of radar systems. In some embodiments, the lens antenna system 100 comprises a hybrid focal source antenna circuit 102 and a lens 104. In some embodiments, the hybrid focal source antenna circuit 102 is configured to provide a source antenna beam 106 to the lens 104. In some embodiments, the lens 104 is configured to receive the source antenna beam 106 and provide a collimated beam 108 (i.e., an output antenna beam), based on the received source antenna beam 106. In some embodiments, the lens 104 comprises a passive component. However, the invention also contemplates the lens 104 to include active configurations, in some embodiments that would allow dynamic reconfiguration of the lens 104. In some embodiments, in order to have narrower beam output from the lens, wider beam from focal source antenna is preferred. However, a wider beam focal source antenna comes with the disadvantage of a higher side-lobe level. Back-lobe level control is another challenge.

Therefore, in some embodiments, the hybrid focal source antenna circuit 102 comprises a set of antenna elements coupled to one another. In some embodiments, the set of antenna elements comprises two or more antenna elements. In some embodiments, the set of antenna elements are configured to be excited in two or more respective co-polarized spherical modes. When an antenna radiates, it creates spherical waves. In other words, the wave front of the radiating waves corresponds to the surface of a sphere. In some embodiments, the electromagnetic radiation pattern of the antenna is defined on the basis of spherical modes. In some embodiments, the spherical mode in which an antenna element is excited defines a beam width associated with the antenna element. For example, an antenna element excited in a lower order spherical mode will have wider beam width and an antenna element excited in a higher-order spherical mode will have narrow beam width. In some embodiments, spherical modes comprise transverse magnetic (TM) modes and transverse electric (TE) modes. However, other spherical modes are also contemplated to be within the scope of this disclosure. In some embodiments, the TM mode comprises a spherical mode in which there is no magnetic field along the direction of propagation. In some embodiments, the TM mode comprises a fundamental TM mode $TM_{01}$ and higher-order TM modes like $TM_{03}$, $TM_{05}$ etc. Similarly, the TE mode comprises a spherical mode in which there is no electric field along the direction of propagation. In some embodiments, the TE mode comprises a fundamental TE mode $TE_{01}$ and higher-order TE modes like $TE_{03}$, $TE_{05}$ etc.

In some embodiments, polarization of an antenna refers to the orientation of the electric field of the radiating EM waves from the antenna. In some embodiments, "co-polarized" spherical modes refer to the spherical modes for which the orientation of electric fields is the same. Therefore, the TM modes and TE modes are not co-polarized with respect to one another. In some embodiments, the TM modes $TM_{01}$, $TM_{03}$, $TM_{05}$ etc. form co-polarized spherical modes. Also, the TE modes $TE_{01}$, $TE_{03}$, $TE_{05}$ etc. form co-polarized spherical modes. In some embodiments, the co-polarized spherical modes associated with at least two antenna elements of the set of antenna elements are different from one another. In some embodiments, utilizing different antenna elements having different co-polarized spherical modes, enables to address the trade-off between beam width and side-lobe level of the output antenna beam 108. Therefore, in some embodiments, the set of antenna elements may be excited in different combinations of co-polarized spherical modes like $TM_{01+}$ $TM_{03}$, $TM_{01+}$ $TM_{05}$, TM01+ $TM_{03+}$ $TM_{05}$, $T_{E01+}$ $TE_{03}$ etc.

Figure 2:
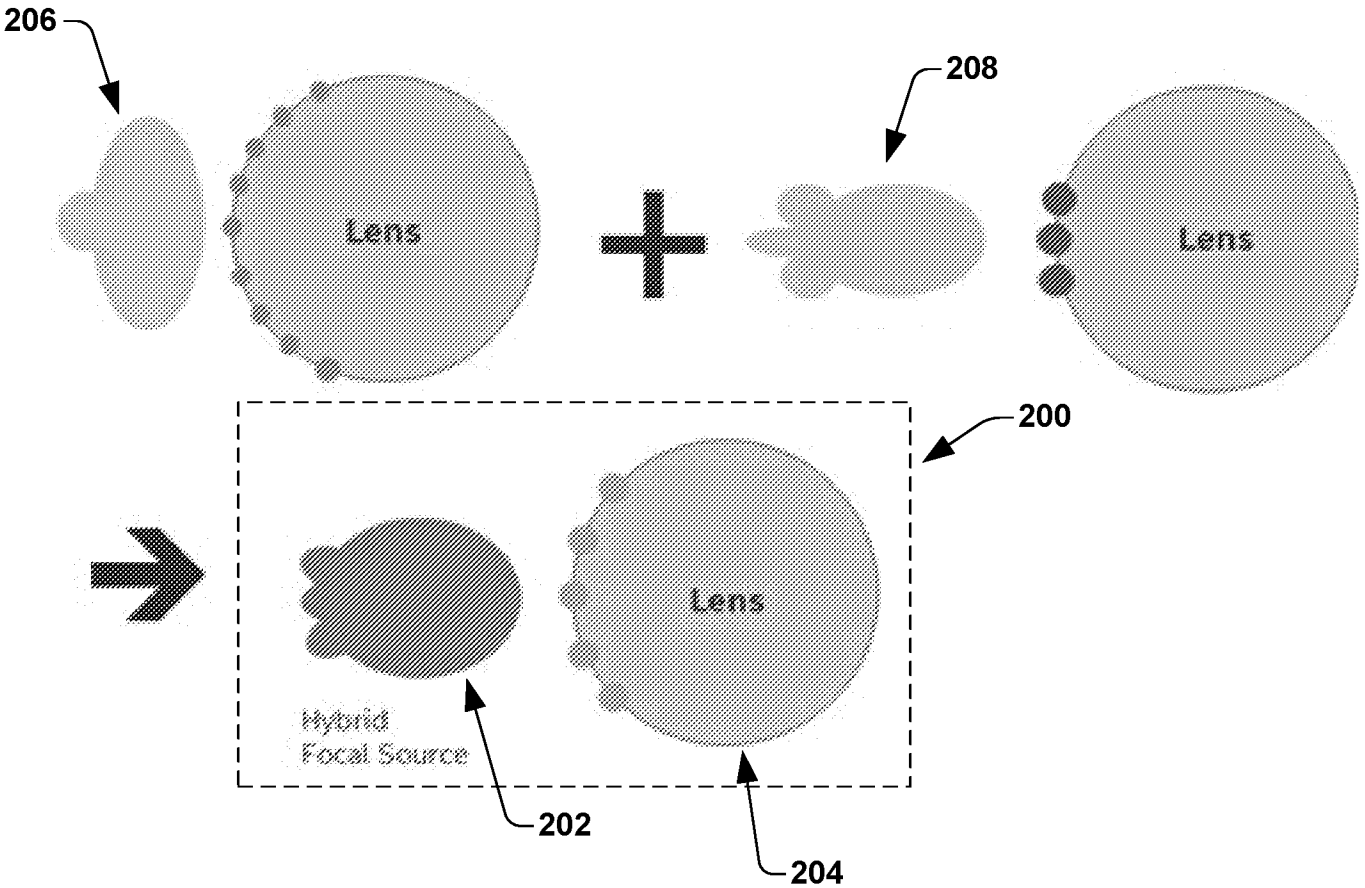
FIG. 2 illustrates an example implementation of a lens antenna system comprising a hybrid focal source antenna circuit, according to one embodiment of the disclosure.

FIG. 2 illustrates an example implementation of a lens antenna system 200, according to one embodiment of the disclosure. In some embodiments, the lens antenna system 200 comprises one possible way of implementation of the lens antenna system 100 in FIG. 1. The lens antenna system 200 comprises a hybrid focal source antenna circuit 202 and a lens 204. In some embodiments, the focal source antenna circuit 202 is configured to generate a source antenna beam and the lens 204 is configured to shape (or collimate) the source antenna beam, to provide an output antenna beam. In some embodiments, the focal source antenna circuit 202 comprises a set of antenna elements coupled to one another. In this embodiment, the set of antenna elements within the focal source antenna circuit 202 comprises a first antenna element (e.g., the first antenna element 206) and a second different antenna element (e.g., the second, antenna element 208). In some embodiments, the first antenna element 206 and the second antenna element 208 are included within the focal source antenna circuit 202, and is shown here separately for ease of understanding. In some embodiments, the first antenna element 206 is excited in a first spherical mode and the second antenna element 208 is excited in a second, different, spherical mode, in order to generate the source antenna beam. In some embodiments, the first antenna element 206 and the second antenna element 208 are coupled to one another. In the embodiments described throughout the disclosure, the term "coupled" may refer to direct coupling (i.e., direct contact) or indirect coupling (e.g., electromagnetic coupling, AC coupling etc.). In this embodiment, the first antenna element 206 and the second antenna element 208 are electrically coupled (e.g., AC coupling) to one another.

In some embodiments, the first spherical mode and the second spherical mode are co-polarized. In some embodiments, the first spherical mode and the second spherical mode comprise transverse magnetic (TM) modes. However, in other embodiments, the first spherical mode and the second spherical mode comprise transverse electric (TE) modes. Alternately, in other embodiments, the first spherical mode and the second spherical mode may comprise any co-polarized spherical modes, different from TM mode or TE mode. In this embodiment, the first antenna element 206 is excited in a lower-order spherical mode (e.g., the fundamental spherical mode $TM_{01}$), thereby resulting in a wide-beam or broad beam (i.e., a low-directivity beam). Therefore, in this embodiment, the first antenna element 206 forms a low-directivity antenna element. Further, in this embodiment, the second antenna element 208 is excited in a higher-order spherical mode (e.g., $TM_{05}$), thereby resulting in a narrow beam (i.e., a high directivity beam). Therefore, in this embodiment, the second antenna element 208 forms a high-directivity antenna element. However, in other embodiments, the first antenna element 206 and the second antenna element 208 may be excited in any combination of different co-polarized spherical modes, for example, $TM_{01+}$ $TM_{03}$, $TM_{01+}$ $TM_{05}$, $TE_{01+}$ $TE_{03}$ etc.

In this embodiment, the set of antenna elements within the hybrid focal source antenna circuit 202 is shown to include only two antenna elements, i.e., the first antenna element 206 and the second antenna element 208. However, in other embodiments, the set of antenna elements within the hybrid focal source antenna circuit 202 may comprise one or more antenna elements, in addition to the first antenna element 206 and the second antenna element 208. In some embodiments, the one or more additional antenna elements are electrically coupled to one another and to the first antenna element 206 and the second antenna element 208. In some embodiments, the one or more additional antenna elements may be configured to be excited in one or more respective co-polarized spherical modes. In some embodiments, the one or more spherical modes associated with the one or more additional antenna elements are co-polarized with respect to the first spherical mode and the second spherical mode. In some embodiments, the one or more spherical modes associated with the one or more additional antenna elements comprises one or more different co-polarized spherical modes and the one or more co-polarized spherical modes are different from the first spherical mode and the second spherical mode. However, in other embodiments, the one or more co-polarized spherical modes associated with the one or more additional antenna elements may be same or different from the first spherical mode and the second spherical mode. In some embodiments, integrating co-polarized, low-directivity and high-directivity antenna elements into a single hybrid focal source antenna circuit in a small form factor provides more design degree of freedom to control desired performance metrics of the output antenna beam that include directivity, side-lobe level, and back-lobe level.

Figure 3B:
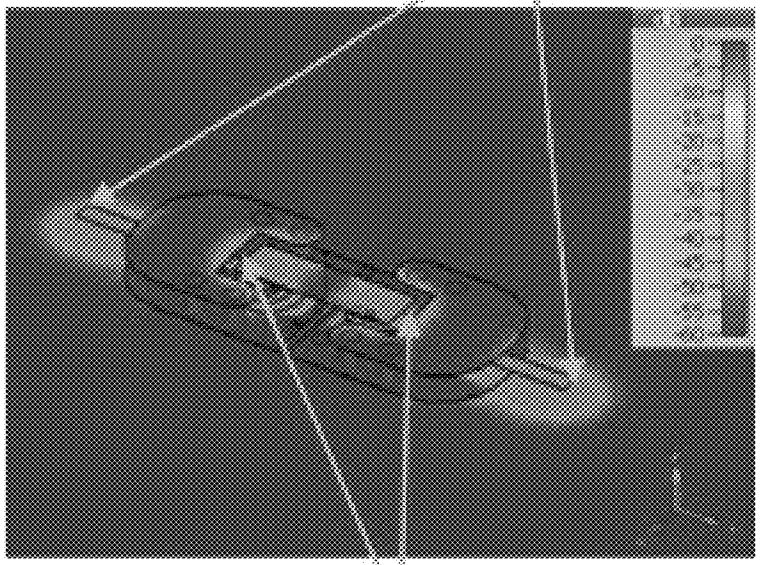
FIG. 3*a* and FIG. 3*b* depicts a 3-dimensional (3D) view of one example hybrid focal source antenna circuit with a single input feed, according to one embodiment of the disclosure.
Figure 3A:
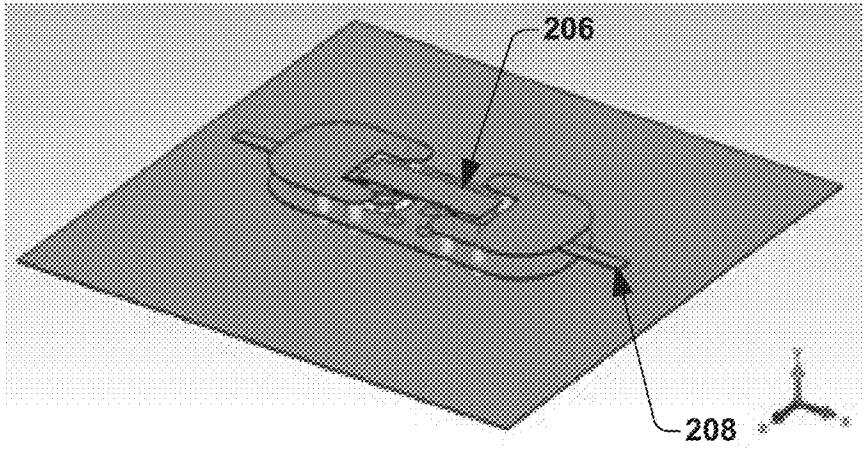
Figure 3C:
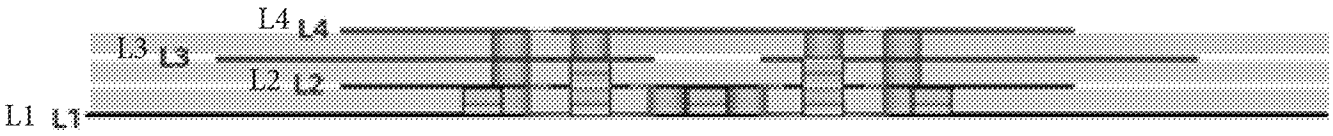
FIG. 3*c* and FIG. 3*d* depicts the different metal layers associated with the hybrid focal source antenna circuit with single input feed, according to one embodiment of the disclosure.
Figure 3D:
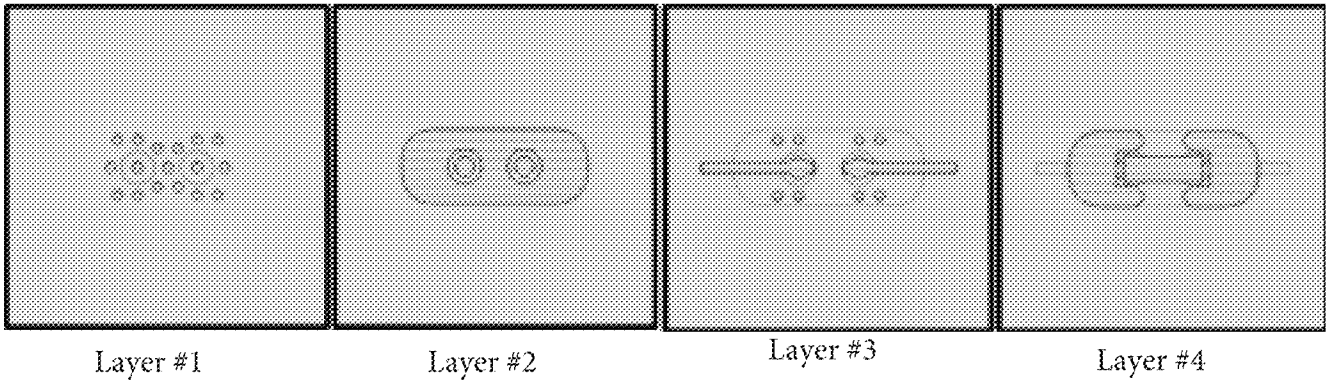
Figure 4B:
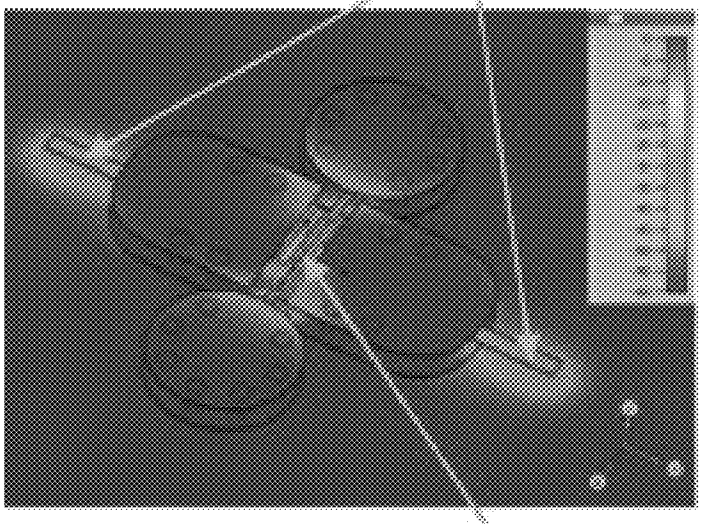
FIG. 4*a* and FIG. 4*b* depicts a 3-dimensional (3D) view of an example hybrid focal source antenna circuit with separate input feeds, according to one embodiment of the disclosure.
Figure 4A:
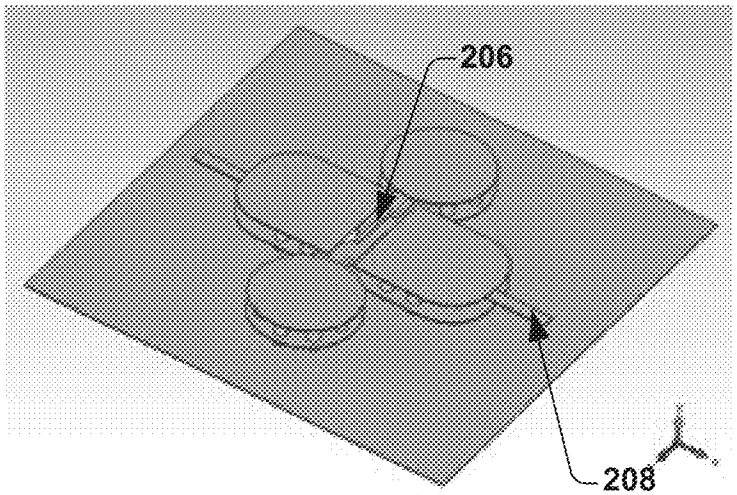
Figure 4C:
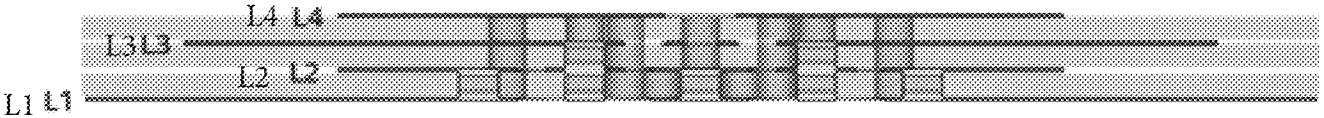
FIG. 4*c* and FIG. 4*d* depicts the different metal layers associated with the exemplary hybrid focal source antenna circuit with separate input feeds, according to one embodiment of the disclosure.
Figure 4D:
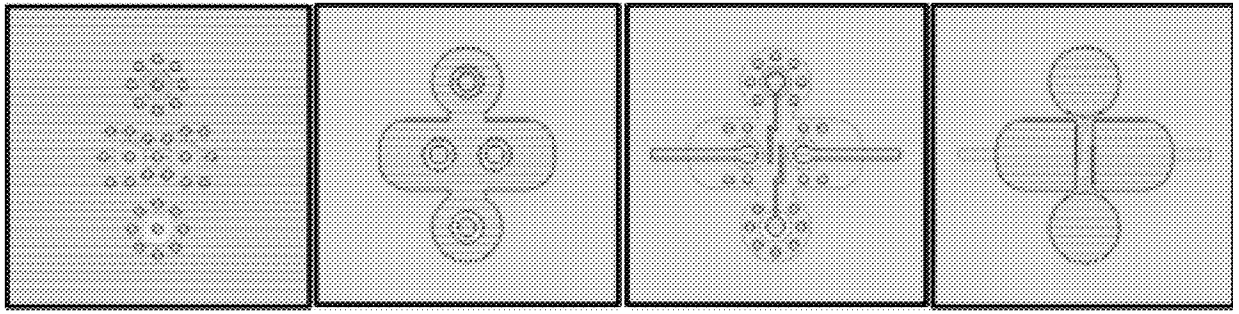

In some embodiments, the first antenna element 206 and the second antenna element 208 may be fed from a single input and are therefore, excited simultaneously, as can be seen in FIGS. 3*a*-3*b*. In some embodiments, FIG. 3*a* and FIG. 3*b* depicts a 3-dimensional (3D) view of the hybrid focal source antenna circuit 202 in FIG. 2 with a single input feed, according to one embodiment of the disclosure. Further, FIG. 3*c* and FIG. 3*d* depicts the different metal layers associated with the hybrid focal source antenna circuit 202 with single input feed, according to one embodiment of the disclosure. Further, in some embodiments, the first antenna element 206 and the second antenna element 208 may be fed separately from 2 separate balanced input feeds (e.g., 2 different power amplifiers (PA)), as can be seen in FIG. 4*a* and FIG. 4*b*. In some embodiments, FIG. 4*a* and FIG. 4*b* depicts a 3-dimensional (3D) view of the hybrid focal source antenna circuit 202 with separate input feeds, according to one embodiment of the disclosure. Further, FIG. 4*c* and FIG. 4*d* depicts the different metal layers associated with the hybrid focal source antenna circuit 202 with separate input feeds, according to one embodiment of the disclosure. In some embodiments, the first antenna element 206 and the second antenna element 208 in FIG. 4*a* and FIG. 4*b* may be excited simultaneously, based on activating both the input feeds. However, in other embodiments, the first antenna element 206 and the second antenna element 208 in FIG. 4*a* and FIG. 4*b* may be excited separately. In the embodiments with separate input feeds, based on application scenario, the output beam from the lens may be reconfigured by turning on/off the PA/LNA (i.e., the input feed) to each element antenna.

Figure 5B:
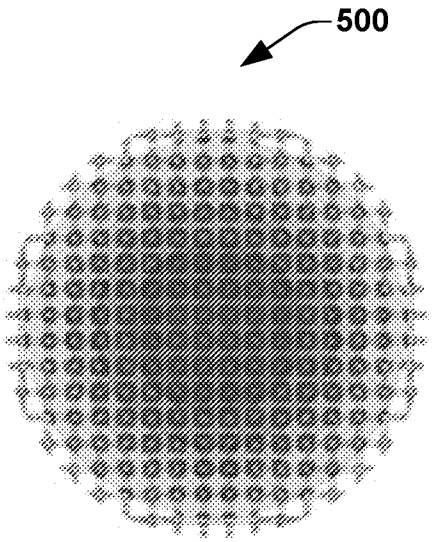
FIG. 5*a* and FIG. 5*b* illustrates an example implementation of a zoned Luneburg lens, according to one embodiment of the disclosure.
Figure 5A:
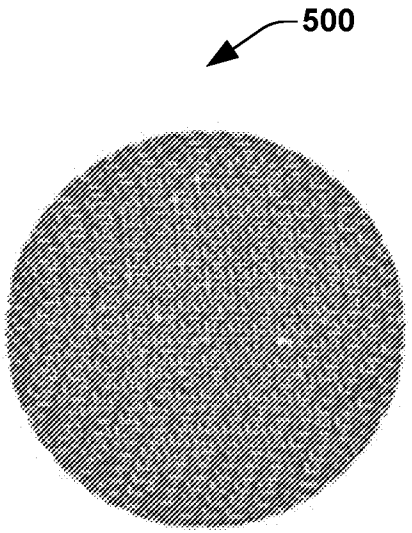

FIG. 5*a* illustrates an example implementation of a lens 500, according to one embodiment of the disclosure. In some embodiments, the lens 500 comprises one possible way of implementation of the lens 204 in FIG. 2 or the lens 104 in FIG. 1. In some embodiments, the lens 500 is referred to herein as zoned Luneburg lens. In some embodiments, the lens 500 comprises a plurality of unit cells. Each unit cell consists a center body and six connection rods to connect to the adjacent unit cells in X, Y, and Z direction. Both the center body and the connection rod can take different shapes. In some embodiments, the lens 500 is divided into a several spherical zones with targeted effective refraction indexes. In each zone, the center body is designed to have its own different volume to achieve the targeted refraction index. In some embodiments, each zone is defined by a spherical surface as can be seen in FIG. 5*b*.

Figure 6:
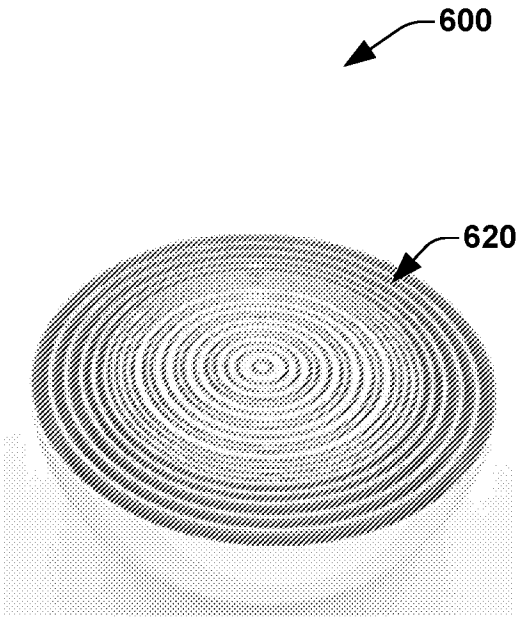
FIG. 6 illustrates an example implementation of a sphere air gap (SAG) lens, according to one embodiment of the disclosure.

FIG. 6 illustrates an example implementation of a lens 600, according to one embodiment of the disclosure. In some embodiments, the lens 600 comprises one possible way of implementation of the lens 204 in FIG. 2 or the lens 104 in FIG. 1. In some embodiments, the lens 600 is referred to herein as sphere air gap (SAG) lens. In particular, FIG. 6 illustrates a multi-shell hemispherical structure 620. In some embodiments, two of the multi-shell hemispherical structures are configured to form the SAG lens. In some embodiments, the thicknesses of shells vary with respect to the radius while the air gaps among the adjacent shells changes accordingly to achieve a varying radial refraction index profile (similar to Luneburg Lens). In some embodiments, the outmost shell of the lens 600 may be perforated to reduce the back scattering caused by the impedance mismatch between the source and the lens. In some embodiments, the lens 600 may be formed with the multi-shell hemispherical structure 620 and a ground plane.

Figure 7B:
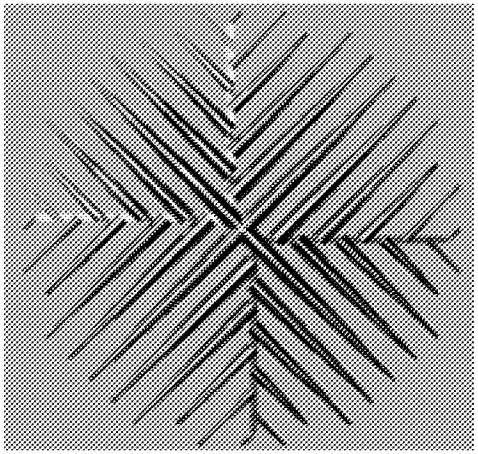
FIG. 7*a* and FIG. 7*b* illustrates an example implementation of a disk lens, according to one embodiment of the disclosure.
Figure 7A:
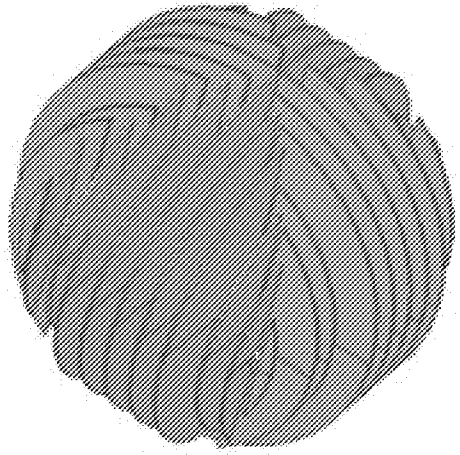

FIG. 7*a* illustrates an example implementation of a lens 700, according to one embodiment of the disclosure. In some embodiments, the lens 700 comprises one possible way of implementation of the lens 204 in FIG. 2 or the lens 104 in FIG. 1. In some embodiments, the lens 700 is referred to herein as disk lens. In some embodiments, the lens 700 comprises an assembly of lens. In some embodiments, the lens 700 is arranged in the form of a sphere. In some embodiments, both the thickness of each disk and the air gap between adjacent disk continuously vary along the radius of the lens to accomplish the refraction index radial variation from $\sqrt{2}$ at the center to 1 at the outmost circumference (e.g., following Luneburg Lens refraction index equation). In some embodiments, the lens 700 is configured to collimate a spherical wave generated by a current source placed at the focus point along one of the axial of the lens. In some embodiments, a hemisphere disk lens can work with a ground plane to form a lens to reduce the profile of the lens. In some embodiments, FIG. 7*b* depicts a top view of the lens 700, according to one embodiment of the disclosure.

Figure 8B:
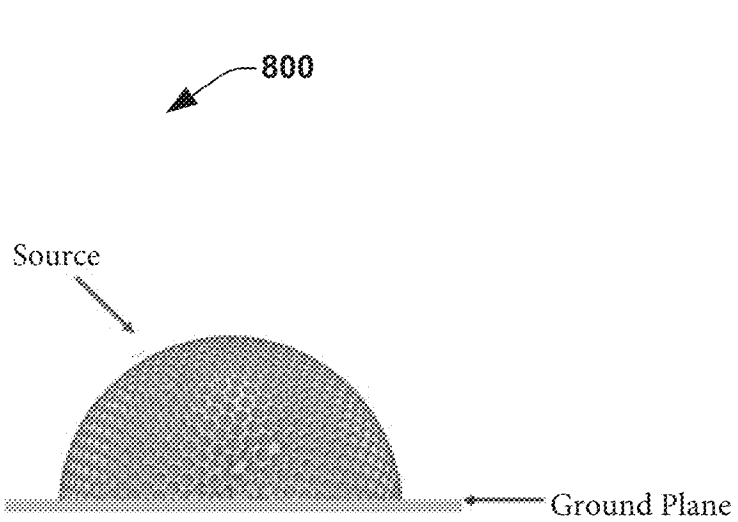
FIG. 8*a* and FIG. 8*b* illustrates an example implementation of a spherical perforated Luneburg lens, according to one embodiment of the disclosure.
Figure 8A:
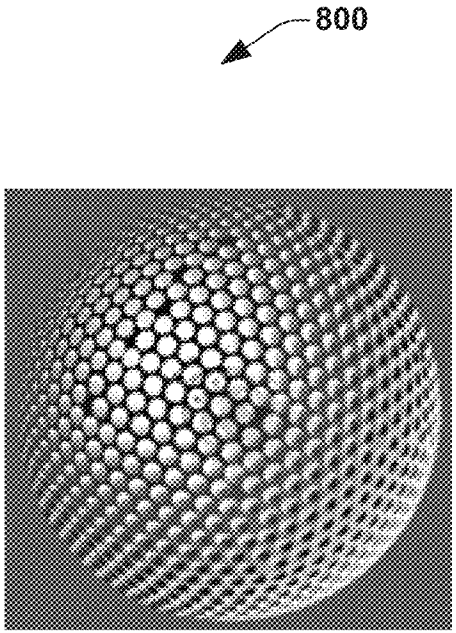

FIG. 8*a* illustrates an example implementation of a lens 800, according to one embodiment of the disclosure. In some embodiments, the lens 800 comprises one possible way of implementation of the lens 204 in FIG. 2 or the lens 104 in FIG. 1. In some embodiments, the lens 800 is referred to herein as spherical perforated Luneburg lens. In some embodiments, the lens 800 is made of multiple layers. In each layer, a perforation ratio is controlled to achieve a desired refraction index (e.g., as indicated by Luneburg Lens equation). Each layer is formed by two hemisphere which images each other. Each layer is printed out individually and then all the layers are assembled to form the lens. In some embodiments, the lens 800 can serve as a collimator to transfer a spherical wave front to a planer wave front. In some embodiments, a hemispherical spherical perforated lens can work with a ground plane to have a similar performance with the profile to be reduced by 2, as can be seen in FIG. 8*b*.

Figure 9B:
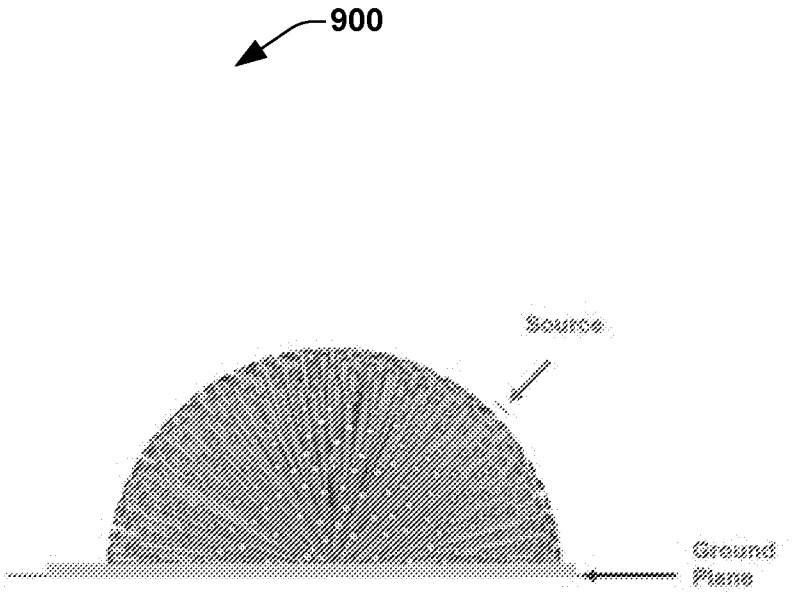
FIG. 9*a* and FIG. 9*b* illustrates an example implementation of a spike lens, according to one embodiment of the disclosure.
Figure 9A:
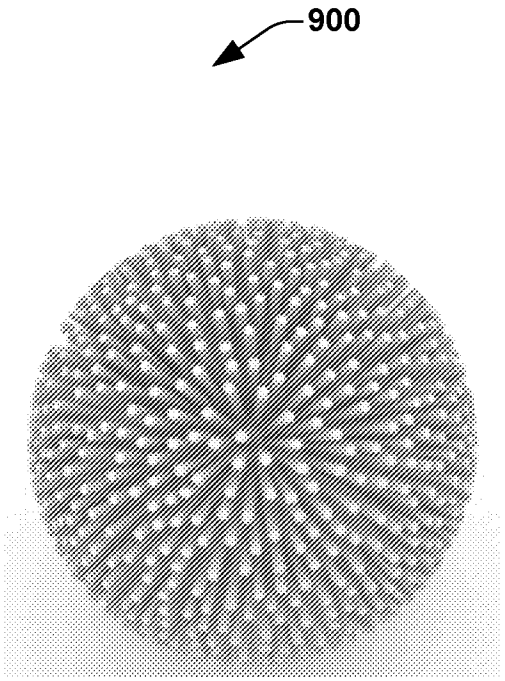

FIG. 9*a* illustrates an example implementation of a lens 900, according to one embodiment of the disclosure. In some embodiments, the lens 900 comprises one possible way of implementation of the lens 204 in FIG. 2 or the lens 104 in FIG. 1. In some embodiments, the lens 900 is referred to herein as spike lens. In some embodiments, the lens 900 is formed with a solid sphere in the center and many spikes. In some embodiments, the spikes are oriented radially and connected to a sphere in the center of the lens. In some embodiments, each spike has a cone shape. In some embodiments, the diameter of the cone changes along the radial direction, so does the space among adjacent spikes to achieve a controllable refraction index (e.g., reminiscent to Luneburg Lens). In some embodiments, a hemispherical spike lens can work with a ground plane to have a similar performance with the profile to be reduced by 2, as can be seen in FIG. 9*b*.

Figure 10:
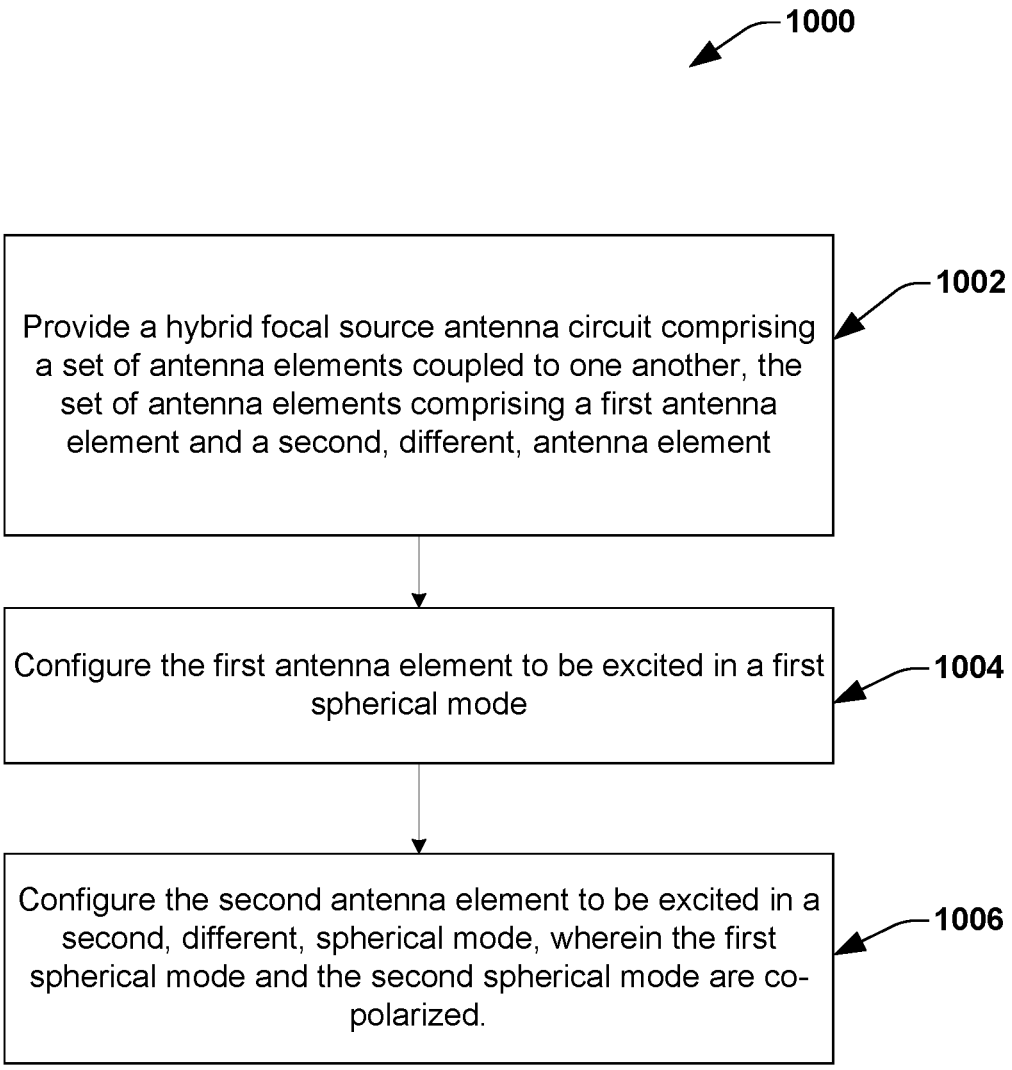
FIG. 10 illustrates a flow chart of a method for an exemplary lens antenna system comprising a hybrid focal source antenna circuit, according to one embodiment of the disclosure.

FIG. 10 illustrates a flow chart of a method 1000 for an exemplary lens antenna system, according to one embodiment of the disclosure. The method 1000 is explained herein with reference to the hybrid focal source antenna circuit 202 in FIG. 2. However, the method 1000 is equally applicable to the hybrid focal source antenna circuit 102 in FIG. 1. At 1002, a hybrid focal source antenna circuit (e.g., the hybrid focal source antenna circuit 202 in FIG. 2) comprising a set of antenna elements coupled to one another is provided. In some embodiments, the set of antenna elements comprises a first antenna element (e.g., the first antenna element 206 in FIG. 2) and a second, different, antenna element (e.g., the second antenna element 208 in FIG. 2). At 1004, the first antenna element is configured to be excited in a first spherical mode. At 1006, the second antenna element is configured to be excited in a second different spherical mode. In some embodiments, the first spherical mode and the second spherical mode are co-polarized. In other embodiments, however, the set of antenna elements may comprise more than two antenna elements configured to be excited in co-polarized spherical modes, as explained above with respect to FIG. 1 and FIG. 2 above.

Figure 11:
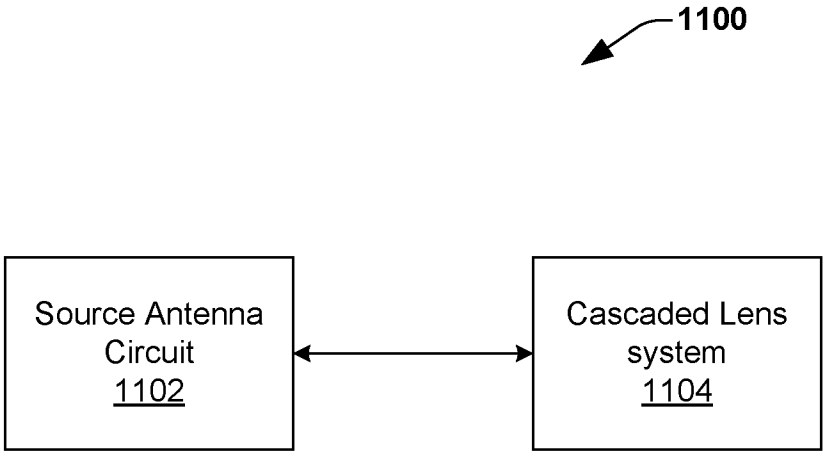
FIG. 11 illustrates a simplified block diagram of an exemplary lens antenna system 1100 comprising a cascaded lens system, according to one embodiment of the disclosure.

FIG. 11 illustrates a simplified block diagram of an exemplary lens antenna system 1100 comprising a cascaded lens system, according to one embodiment of the disclosure. In some embodiments, the lens antenna system 1100 may be part of wireless communication systems, for example, mmW systems. Further, in some embodiments, the lens antenna system 1100 may be part of radar systems. The lens antenna system 1100 comprises a source antenna circuit 1102 and a cascaded lens system 1104. In some embodiments, the source antenna circuit 1102 may comprise a focal source antenna circuit configured to generate a source antenna radiation. In some embodiments, the focal source antenna circuit is configured to generate the source antenna radiation based on an excitation signal associated with a communication circuit. In some embodiments, the source antenna radiation is not Gaussian profile (fundamental intensity mode) and therefore hard to achieve high directivity.

In some embodiments, the cascaded lens system 1104 may comprise a quasi-collimated lens L1 (not shown here) configured to receive a source antenna radiation associated with the source antenna circuit 1102 and collimate the source antenna radiation to form a collimated beam. As explained herein, in this embodiment, the quasi collimated lens L1 is considered to be part of the cascaded lens system. However, in other embodiments, quasi collimated lens L1 may be part of the source antenna circuit. The collimated beam provided by the quasi collimated lens L1 is in spatial domain. In some embodiments, the collimated beam provided by the quasi collimated lens L1 comprises the fundamental spatial frequency component and higher-order spatial frequency components. In order to achieve a highly-directive output beam, in some embodiments, unwanted spatial frequency components associated with the collimated beam needs to be filtered out. In order to filter out the unwanted spatial frequency components associated with the collimated beam, in some embodiments, the collimated beam needs to be converted from spatial domain (where the fundamental spatial frequency component and higher-order spatial frequency components are spatially distributed) to spatial frequency domain.

In some embodiments, the cascaded lens system 1104 may further comprise a focusing lens L2 (not shown here) configured to receive the collimated beam and focus the collimated beam, in order to convert the collimated beam from spatial domain to spatial frequency domain, thereby forming a focused beam at a focal plane associated with the focusing lens L2. In some embodiments, the focusing lens L2 is configured to convert the collimated beam from spatial domain to spatial frequency domain (thereby forming the focused beam), based on utilizing the lens' Fourier transform operation (e.g., 2D Fourier transform), as given below:

$$F(u,v)=\int_{-\infty}^{\infty}\int_{-\infty}^{\infty}f(x,y)e^{-j2\pi(ux+vy)}dxdy \quad (1)$$

Where u and v are spatial frequency in x and y direction (propagation in z), respectively. In some embodiments, higher order spatial frequency components associated with the focused beam will have different focal points that is spatially separated from the fundamental mode focal point. For example, in some embodiments, the 2D Fourier transform of Lens L2 will result in spatially separated high-order spatial frequency components, i.e., lower spatial frequency components are located at/near a center focal point while other high-order spatial frequency components will be focused at locations away from the center focal point.

In some embodiments, the cascaded lens system 1104 may further comprise a collimation lens L3 (not shown here) configured to couple to the focused beam and collimate the focused beam (or a select spatial frequency component associated therewith), thereby forming a real collimated beam. In some embodiments, the real collimated beam comprises a highly directive beam. In some embodiments, the collimation lens L3 is configured to collimate the focused beam based on utilizing inverse of the lens' Fourier transform operation, as given below:

$$f(x,y)=\int_{-\infty}^{\infty}\int_{-\infty}^{\infty}F(u,v)e^{j2\pi(ux+vy)}dudv \quad (2)$$

Where u and v are spatial frequency in x and y direction (propagation in z), respectively. In some embodiments, the select spatial frequency component comprises a fundamental spatial frequency component. However, in other embodiments, the select spatial frequency component may comprise one or more spatial frequency components. In some embodiments, the cascaded lens system 1104 may comprise a spatial filter plate (not shown here) located between the focusing lens L2 and the collimation lens L3, configured to filter out unwanted spatial frequency components associated with the focused beam, thereby providing the select spatial frequency component associated with the focused beam to the collimation lens.

In some embodiments, the spatial filter plate comprises an aperture A that allows only the select frequency component (e.g., the fundamental spatial frequency component associated with the focused beam) to pass through. In some embodiments, the spatial filter plate may comprise a non-radio frequency (RF) transparent plate and the aperture may take a form of a hole in the non-radio frequency (RF) transparent plate where the center of the hole coincides with the lens focal point (i.e., the center focal point). However, in other embodiments, the spatial filter plate may be implemented to be different from a non-RF transparent plate, as long as the spatial filter plate provides the required attenuation. Lower-order spatial frequency EM waves at/near the focal point can pass through the hole and continue propagating further while higher-order spatial frequency components will be blocked (e.g., by the non-RF-transparent portion of the plate) and stop propagating. By filtering out the higher order spatial frequencies, theoretically, a perfect plane wave can be approximated after re-collimation. The desired spatial filtering aperture size A is proportional to the wavelength of the radiation and selections of L1/L2 lensing parameters. Alternately, in other embodiments, the cascaded lens system 1104 may not comprise a spatial filter plate. Instead, in such embodiments, a distance of the collimation lens L3 from the focusing lens L2 or a size of the collimation lens L3 is adjusted, in order to filter out unwanted spatial frequency components associated with the focused beam, thereby enabling the collimation lens L3 to receive the select spatial frequency component associated with the focused beam. Further, in some embodiments, the quasi-collimated lens L1 and the focusing lens L2 may be integrated together to form a single lens. In some embodiments, the lens L1, L2 and L3 comprise passive components. However, the invention also contemplates the lens L1, L2 and L3 to include active configurations, in some embodiments that would allow dynamic reconfiguration of the lens L1, L2 and L3.

Figure 12A:
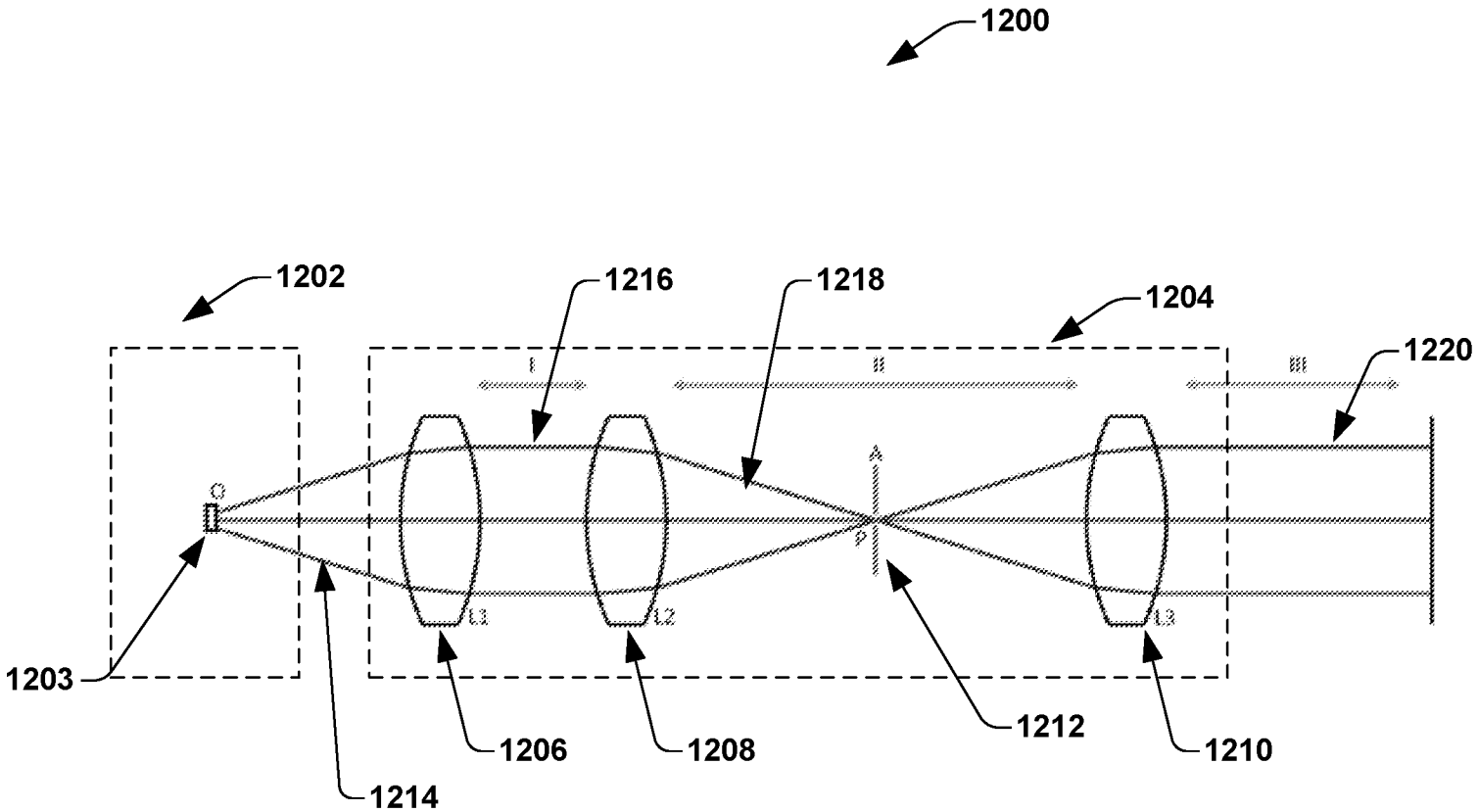
FIG. 12*a* depicts an example implementation of a lens antenna system comprising a cascaded lens system, according to one embodiment of the disclosure.

FIG. 12*a* depicts an example implementation of a lens antenna system 1200, according to one embodiment of the disclosure. In some embodiments, the lens antenna system 1200 comprises one possible way of implementation of the lens antenna system 1100 in FIG. 11. The lens antenna system 1200 comprises a source antenna circuit 1202 and a cascaded lens system 1204. In some embodiments, the source antenna circuit 1202 is configured to generate a source antenna radiation 1214. In some embodiments, the source antenna circuit 1202 comprises a focal source antenna circuit 1203 configured to generate the source antenna radiation 1214 based on an excitation signal associated with a communication circuit. In some embodiments, the source antenna radiation 1214 is not Gaussian profile (fundamental intensity mode) and therefore hard to achieve high directivity. In some embodiments, the source antenna circuit 1202 may comprise a single antenna element or a plurality of antenna elements (e.g., a phased array antenna).

In some embodiments, the cascaded lens system 1204 comprises a quasi-collimated lens L1 1206 configured to receive the source antenna radiation 1214 associated with the source antenna circuit 1202 and collimate the source antenna radiation 1214 to form a collimated beam 1216. In this embodiment, the quasi collimated lens L1 1206 is shown to be part of the cascaded lens system 1204. However, in other embodiments, quasi collimated lens L1 1206 may be part of the source antenna circuit 1202. The collimated beam 1216 provided by the quasi collimated lens L1 1206 is in spatial domain. In some embodiments, the collimated beam 1216 provided by the quasi collimated lens L1 1206 comprises the fundamental spatial frequency component and higher-order spatial frequency components. In order to achieve a highly-directive output beam, in some embodiments, unwanted spatial frequency components associated with the collimated beam 1216 needs to be filtered out. In order to filter out the unwanted spatial frequency components associated with the collimated beam 1216, in some embodiments, the collimated beam 1216 needs to be converted from spatial domain (where the fundamental spatial frequency component and higher-order spatial frequency components are spatially distributed) to spatial frequency domain.

In some embodiments, the cascaded lens system 1204 further comprises a focusing lens L2 1208 configured to receive the collimated beam 1216 and focus the collimated beam 1216, in order to convert the collimated beam 1216 from spatial domain to spatial frequency domain, thereby forming a focused beam 1218 at a focal plane associated with the focusing lens L2 1208. In some embodiments, the focusing lens L2 1208 is configured to convert the collimated beam 1216 from spatial domain to spatial frequency domain (thereby forming the focused beam 1218), based on utilizing the lens' Fourier transform operation (e.g., 2D Fourier transform), as explained above with respect to equation (1). In some embodiments, higher order spatial frequency components associated with the focused beam 1218 will have different focal points that is spatially separated from the fundamental mode focal point. For example, in some embodiments, the 2D Fourier transform of focusing lens L2 1208 will result in spatially separated high-order spatial frequency components, i.e., lower spatial frequency components are located at/near a center focal point while other high-order spatial frequency components will be focused at locations away from the center focal point.

In some embodiments, the cascaded lens system 1204 further comprises a spatial filter plate 1212 configured to filter out higher order spatial frequency components associated with the focused beam 1218, thereby allowing a fundamental spatial frequency component associated with the focused beam 1218 to pass through. In some embodiments, the spatial filter plate 1212 comprises an aperture A that allows only the fundamental spatial frequency component associated with the focused beam 1218 to pass through. In some embodiments, the aperture may take a form of a hole in a non-radio frequency (RF) transparent plate where the center of the hole coincides with the lens focal point (i.e., the center focal point), in order to allow the fundamental spatial frequency component to pass through the hole, while blocking higher-order spatial frequency components. However, other implementations of the spatial filter plate 1212 are also contemplated to be within the scope of this disclosure. In some embodiments, the spatial filter plate 1212 may be arranged at the focal plane associated with the focusing lens L2 1208. In this embodiment, the spatial filter plate 1212 is configured to allow only the fundamental spatial frequency component associated with the focused beam 1218 to pass through. However, in other embodiments, the spatial filter plate 1212 may be configured to allow one or more spatial frequency components (different from the fundamental spatial frequency component) associated with the focused beam 1218.

In some embodiments, the cascaded lens system 1204 further comprises a collimation lens L3 1210 configured to couple to the focused beam 1218 (that pass through the spatial filter plate 1212) and collimate a select spatial frequency component (e.g., a fundamental spatial frequency component) associated with the focused beam 1218, thereby forming a real collimated beam 1220. In some embodiments, the real collimated beam 1220 comprises a highly directive beam. In some embodiments, the collimation lens L3 1210 is configured to collimate the focused beam 1218 based on utilizing inverse of the lens' Fourier transform operation, as given above in equation (2). In this embodiment, the select spatial frequency component comprises a fundamental spatial frequency component. However, in other embodiments, the select spatial frequency component may comprise one or more spatial frequency components (that pass through the spatial plate 1212).

Figure 12B:
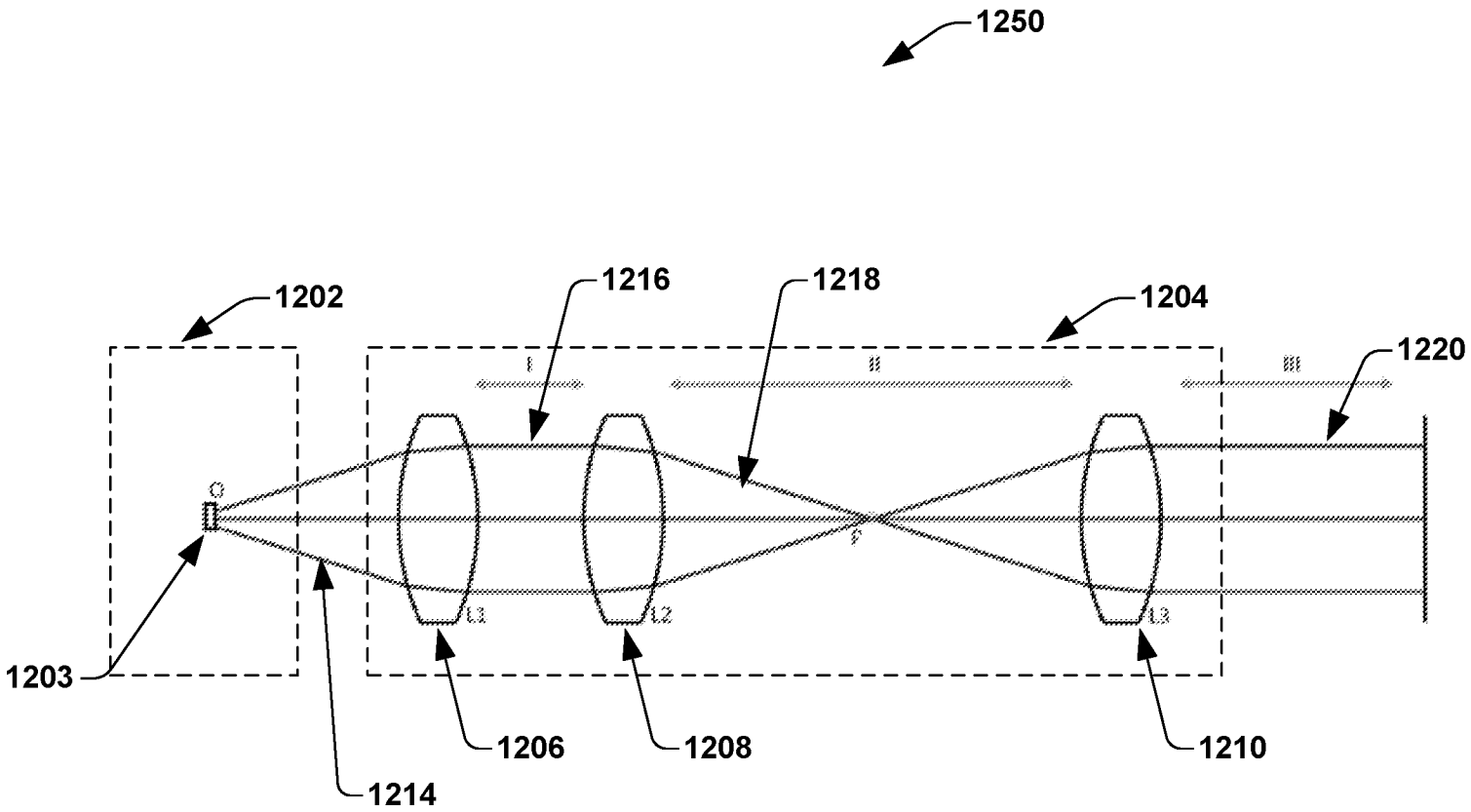
FIG. 12*b* depicts another example implementation of a lens antenna system comprising a cascaded lens system, according to one embodiment of the disclosure.

In some embodiments, the cascaded lens system 1204 may not comprise a spatial filter plate 1212, as illustrated in the cascaded lens system 1204 in FIG. 12*b*. In some embodiments, the lens antenna system 1250 in FIG. 12*b* is similar to the lens antenna system 1200 in FIG. 12*a*, with the exception of the spatial filter plate 1212. Therefore, in such embodiments, a design of the collimation lens L3 1210 is configured, in order to filter out higher order spatial frequency components (or unwanted spatial frequency components) associated with the focused beam 1218. In such embodiments, the collimation lens L3 1210 acts as an indirect filter. In particular, in some embodiments, a distance of the collimation lens L3 1210 from the focusing lens L2 1208 or a size (or aperture) of the collimation lens L3 1210 is adjusted, in order to filter out unwanted spatial frequency components associated with the focused beam 1218, thereby enabling the collimation lens L3 1210 to receive only the select spatial frequency component associated with the focused beam 1218. The lens antenna system 1250 is not further described herein, as all the explanations associated with the lens antenna system 1200 in FIG. 12*a* is also applicable to the lens antenna system 1250 in FIG. 12*b*.

Figure 13:
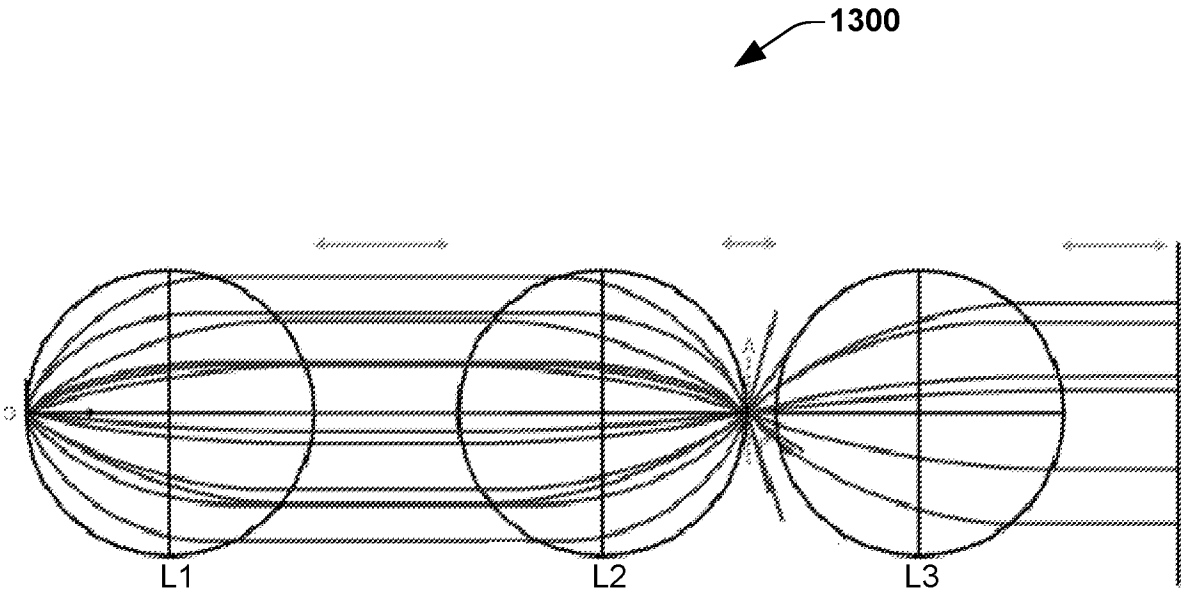
FIG. 13 illustrates an exemplary lens antenna system comprising a cascaded lens system using Luneburg GRIN lenses, according to one embodiment of the disclosure.
Figure 14:
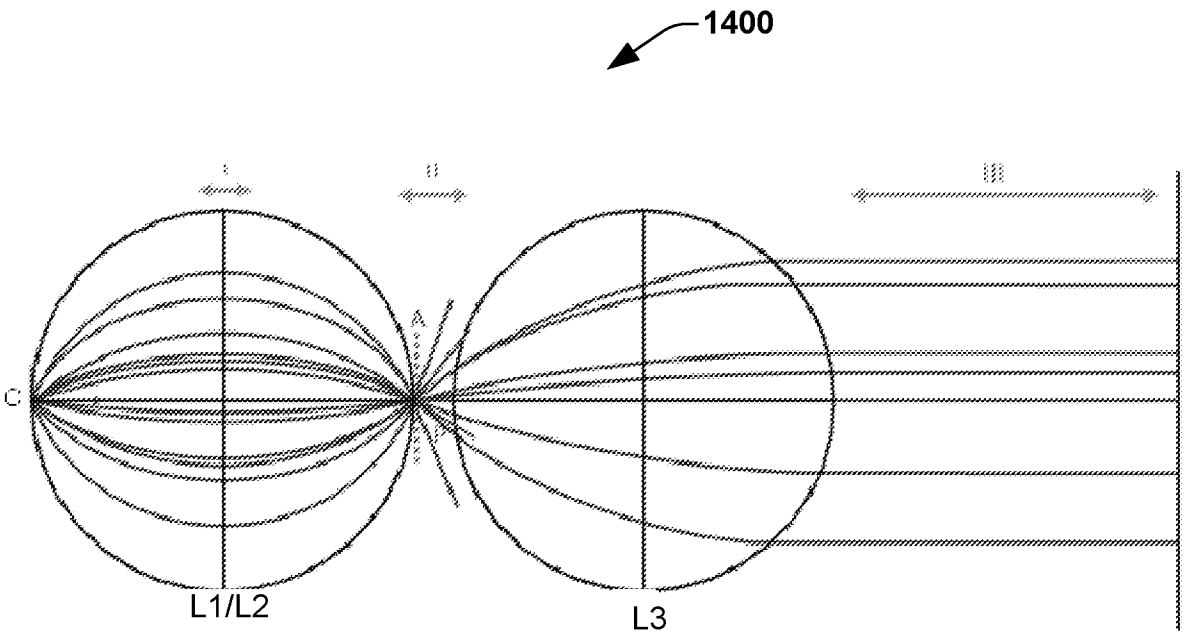
FIG. 14 illustrates an exemplary lens antenna system comprising a cascaded lens system using Maxwell's Fish-eye GRIN lens for lens L1/L2 and Luneburg GRIN lens for lens L3, according to one embodiment of the disclosure.

The lensing options in the cascaded lensing system 1204 in FIGS. 12*a* and 12*b* may include various aspherical/freeform standard lens surface profiles with constant material index to avoid adding spherical aberrations to the system. Further, in some embodiments, the lensing aperture of the collimation lens (L3) 1210 can also be a control parameter to expand/shrink spatial beam width of the generated directive EM radiation (i.e., the real collimated beam) and to supply desired beam width in certain propagation range for particular application implementations. In addition to lens surface profile options, in some embodiments, gradient index (GRIN) lensing options may also be implemented. For example, FIG. 13 illustrates a lens antenna system 1300 comprising a cascaded lens system using Luneburg GRIN lenses. In particular, the quasi-collimates lens L1, the focusing lens L2 and the collimated lens L3 comprise Luneburg GRIN lenses. Further, FIG. 14 illustrates a lens antenna system 1400 comprising a cascaded lens system using Maxwell's Fish-eye GRIN lens for lens L1/L2 and Luneburg GRIN lens for lens L3. In the embodiment of FIG. 14, the quasi-collimates lens L1 and the focusing lens L2 are integrated as a single lens. GRIN lensing options are highly configurable and can achieve aberration-free wavefront transformations. Further, the spatial filtering may be realized in the lens antenna systems 1300 and 1400, based on direct spatial filtering (e.g., a spatial filter plate) or based on indirect spatial filtering (by configuring L3 design to neglect higher order spatial frequency components at the focal plane).

Figure 15:
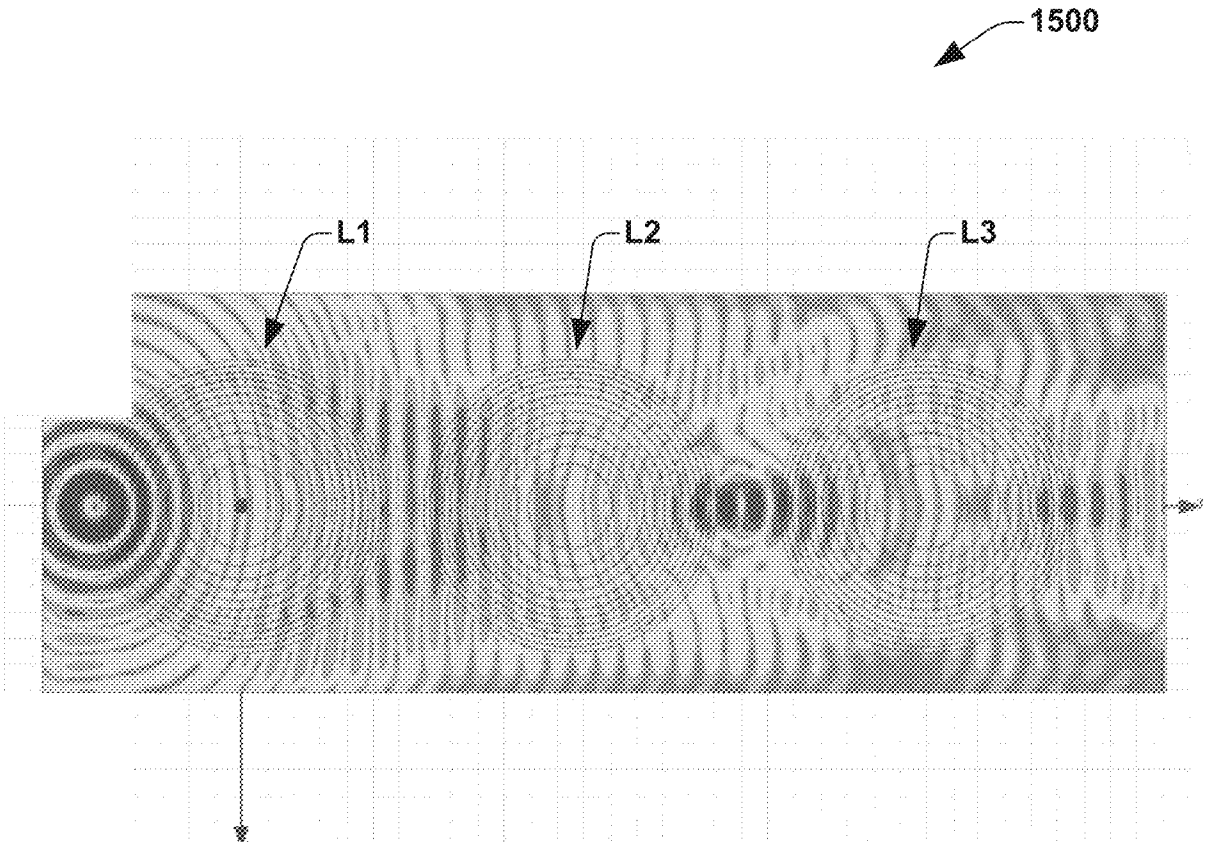
FIG. 15 illustrates a full-wave simulation corresponding to an exemplary cascaded lens system (indirect filtering) using Luneburg GRIN lenses without using the spatial plate, according to one embodiment of the disclosure.

FIG. 15 illustrates a full-wave simulation corresponding to an exemplary cascaded lens system 1500 using Luneburg GRIN lenses (as shown in FIG. 13) without using the spatial plate (indirect filtering). Here the deviation of radiation feed-antenna from fundamental mode results in quasi-collimation after the first GRIN lens (L1). To further increase the directivity of the RF radiation pattern (collimation), a second GRIN lens (L2) is used to focus the wave fronts and enables spatially separated higher order mode of the radiation pattern from the fundamental mode. In FIG. 15, it is clearly shown that a small portion of the radiation cannot be focused. This part of the energy corresponds to a small amount of radiation (wave fronts) from the original feed antenna that are corresponding to higher order mode intensity distribution. Here by proper design of the third GRIN lens (L3), the lens L3 is placed at certain distance away from the second lens L2 so that the lens L3 is not collecting the higher order mode energy. As a result, a highly energy concentrated beam generation with improved angular EM radiation is generated. In some embodiments, the first lens L 1, the second lens L2, combined with the indirect spatial filtering implementation (i.e., lens L3), serve as a "wave front cleaner" to help reducing the imperfection of the original source radiation.

Figure 16:
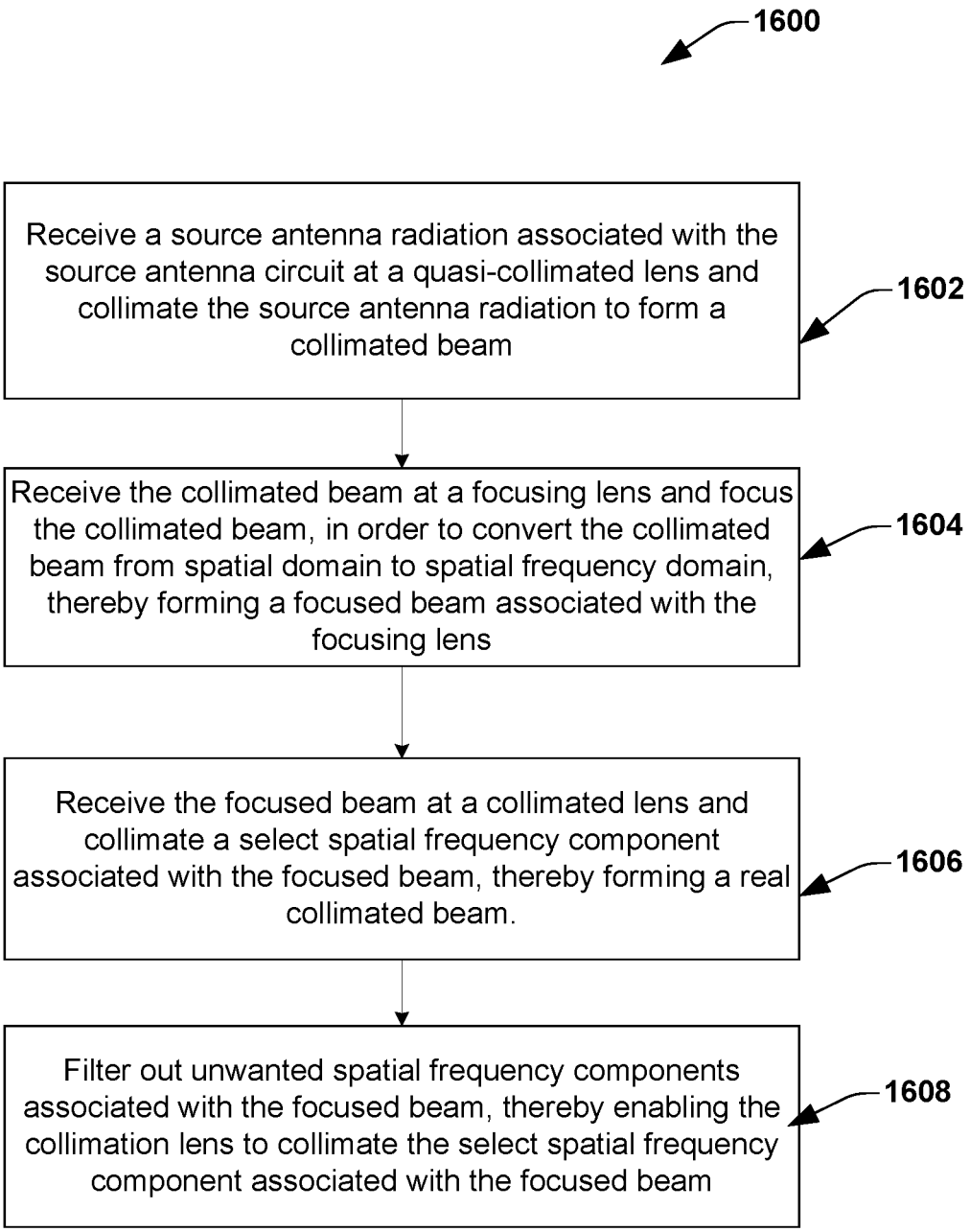
FIG. 16 illustrates a flow chart of a method for an exemplary lens antenna system comprising a cascaded lens system, according to one embodiment of the disclosure.

FIG. 16 illustrates a flow chart of a method 1600 for an exemplary lens antenna system, according to one embodiment of the disclosure. The method 1600 is explained herein with reference to the lens antenna system 1200 in FIG. 12*a* and the lens antenna system 1250 in FIG. 12*b*. However, the method 1200 is equally applicable to the lens antenna systems 1100, 1300 and 1400 in FIG. 11, FIG. 13 and FIG. 14, respectively. At 1602, a source antenna radiation (e.g., the source antenna radiation 1214 in FIG. 12*a*) associated with a source antenna circuit (e.g., the source antenna circuit 1202 in FIG. 12*a*) is received at a quasi-collimated lens (e.g., the quasi-collimated lens L1 1206 in FIG. 12*a*). Further, the source antenna radiation is collimated at the quasi-collimated lens to form a collimated beam (e.g., the collimated beam 1216 in FIG. 12*a*). At 1604, the collimated beam is received at a focusing lens (e.g., the focusing lens 1208 in FIG. 12*a*). Further, the collimated beam is focused by the focusing lens, in order to convert the collimated beam from spatial domain to spatial frequency domain, thereby forming a focused beam (e.g., the focused beam 1218 in FIG. 12*a*) associated with the focusing lens.

At 1606, the focused beam is received at a collimated lens (e.g., the collimated lens 1210 in FIG. 12*a*). Further, a select spatial frequency component associated with the focused beam is collimated at the collimated lens, thereby forming a real collimated beam (e.g., the real collimated beam 1220 in FIG. 12*a*). At 1608, unwanted spatial frequency components associated with the focused beam are filtered out, thereby enabling the collimation lens to collimate the select spatial frequency component associated with the focused beam. In some embodiments, the unwanted spatial frequency components are filtered out by using a spatial filer plate (e.g., the spatial filter plate 1212 in FIG. 12*a*), based on a direct filtering approach. However, in other embodiments, the unwanted spatial frequency components are filtered out by using an indirect filtering approach (e.g., by configuring the design of the collimation lens L3), as explained above with respect to FIG. 12*b* above.

Figure 17:
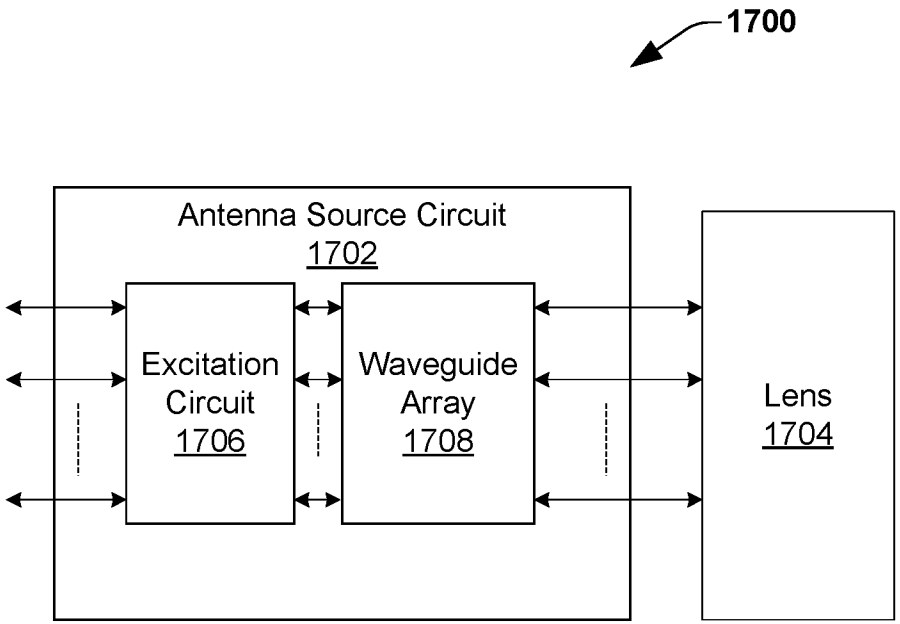
FIG. 17 illustrates a simplified block diagram of an exemplary lens antenna system comprising a waveguide array, according to one embodiment of the disclosure.

FIG. 17 illustrates a simplified block diagram of an exemplary lens antenna system 1700, according to one embodiment of the disclosure. In some embodiments, the lens antenna system 1700 may be part of wireless communication systems, for example, mmW systems. Further, in some embodiments, the lens antenna system 1700 may be part of radar systems. The lens antenna system 1700 comprises an antenna source circuit 1702 and a lens 1704. In some embodiments, the lens 1704 comprises a passive component. However, the invention also contemplates the lens 1704 to include active configurations, in some embodiments that would allow dynamic reconfiguration of the lens 1704. In some embodiments, the antenna source circuit 1702 comprises an excitation circuit 1706 and a waveguide array 1708. In some embodiments, the waveguide array 1708 may comprise a set of waveguides configured to convey electromagnetic waves associated with a communication circuit. In some embodiments, each of the set of waveguides comprises a structure configured to convey electromagnetic waves/radiations. In some embodiments, the set of waveguides comprises one or more waveguides.

In some embodiments, the lens 1704 is coupled with the set of waveguides. In some embodiments, the set of waveguides associated with the waveguide array 1708 is directly connected/coupled to the lens 1704. However, in other embodiments, the set of waveguides associated with the waveguide array 1708 may be indirectly coupled to the lens 1704 (e.g., coupled via the electromagnetic waves). In some embodiments, the lens 1704 is configured to receive the electromagnetic waves associated with one or more waveguides of the set of waveguides, in order to provide one or more output antenna beams. In some embodiments, the set of waveguides associated with the waveguide array 1708 may be implemented in a rod like structure. However, in other embodiments, the set of waveguides associated with the waveguide array 1708 may be implemented differently, for example, a substrate integrated waveguide (SIW). In some embodiments, the set of waveguides associated with the waveguide array 1708 comprises a set of dielectric waveguides made of dielectric material. In some embodiments, the set of waveguides comprises a set of dielectric rods. In some embodiments, the material of the waveguides possesses a relative dielectric permittivity of 2 or higher. However, in other embodiments, the set of waveguides may be implemented differently.

In some embodiments, the excitation circuit 1706 is configured to generate the electromagnetic waves based on communication signals (e.g., electrical signals) associated with the communication circuit. In some embodiments, the excitation circuit 1706 may comprise a mode launcher circuit (not shown) configured to convert electrical signals associated with the communication circuit to the electromagnetic waves. In some embodiments, the mode launcher circuit may comprise a set of mode launcher circuits coupled respectively to the set of waveguides and configured to generate a respective set of electromagnetic waves, in order to provide excitation to the set of waveguides. In some embodiments, the excitation circuit 1706 may further comprise a beam switching network (not shown) configured to provide one or more electrical signals at the input of the mode launcher circuit, based on the communication signals associated with the communication circuit, at any instance. Therefore, at any instance, the lens is configured to receive electromagnetic waves from one or more waveguides and provide one or more output antenna beams based thereon. In some embodiments, the beam switching network is configured to provide the one or more electrical signals, in accordance with a predefined beam control algorithm.

Figure 18:
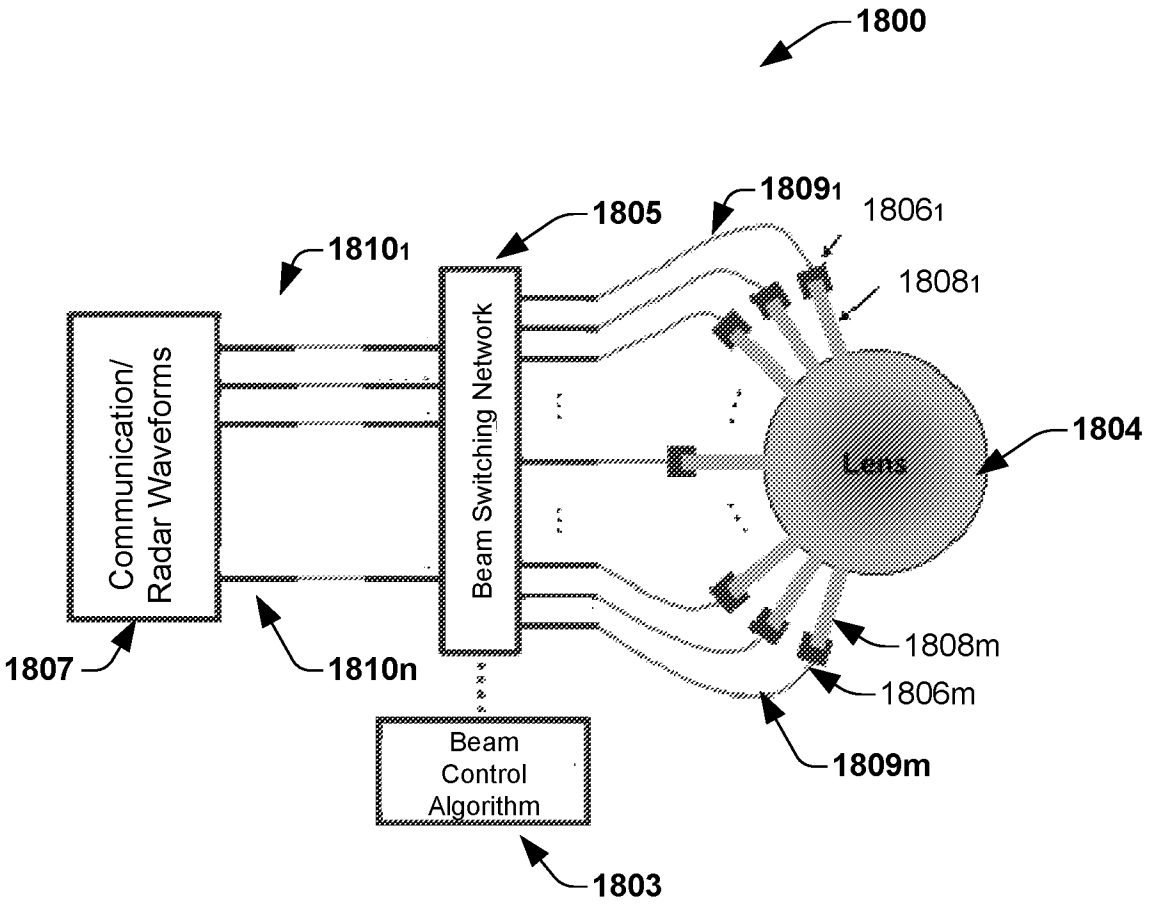
FIG. 18 depicts an example implementation of a lens antenna system comprising a waveguide array, according to one embodiment of the disclosure.

FIG. 18 depicts an example implementation of a lens antenna system 1800, according to one embodiment of the disclosure. In some embodiments, the lens antenna system 1800 comprises one possible way of implementation of the lens antenna system 1700 in FIG. 17. The lens antenna system 1800 comprises a lens 1804 and a waveguide array comprising a set of waveguides $\mathbf{1808}_1 \ldots \mathbf{1808}m$. In other embodiments, the waveguide array may comprise any number of waveguides, for example, one or more waveguides. In some embodiments, the set of waveguides $\mathbf{1808}_1 \ldots \mathbf{1808}m$ is configured to convey electromagnetic waves associated with a communication circuit 1807. In some embodiments, each waveguide of the set of waveguides $\mathbf{1808}_1 \ldots \mathbf{1808}m$ comprises a structure configured to convey electromagnetic waves/radiations. In some embodiments, the set of waveguides $\mathbf{1808}_1 \ldots \mathbf{1808}m$ associated with the waveguide array comprises a set of dielectric waveguides made of dielectric material. In some embodiments, the set of waveguides $\mathbf{1808}_1 \ldots \mathbf{1808}m$ comprises a set of dielectric rods. However, in other embodiments, the set of waveguides $\mathbf{1808}_1 \ldots \mathbf{1808}m$ may be implemented differently.

In some embodiments, the lens 1804 is coupled with the set of waveguides $\mathbf{1808}_1 \ldots \mathbf{1808}m$. In some embodiments, the lens 1804 is configured to receive the electromagnetic waves associated with one or more waveguides of the set of waveguides 1808$_1$ . . . 1808*m*, in order to provide one or more output antenna beams. In some embodiments, the set of waveguides 1808$_1$ . . . 1808*m* associated with the waveguide array is directly connected/coupled to the lens 1804. However, in other embodiments, the set of waveguides 1808$_1$ . . . 1808*m* associated with the waveguide array may be indirectly coupled to the lens 1804 (e.g., placed close to one another and coupled via the electromagnetic waves). In some embodiments, the lens antenna system 1800 further comprises a mode launcher circuit comprising a set of mode launcher circuits 1806$_1$ . . . 1806*m* coupled respectively to the set of waveguides 1808$_1$ . . . 1808*m*. In some embodiments, the mode launcher circuit is configured to generate the electromagnetic waves based on communication signals (e.g., electrical signals) associated with the communication circuit 1807.

Figure 19B:
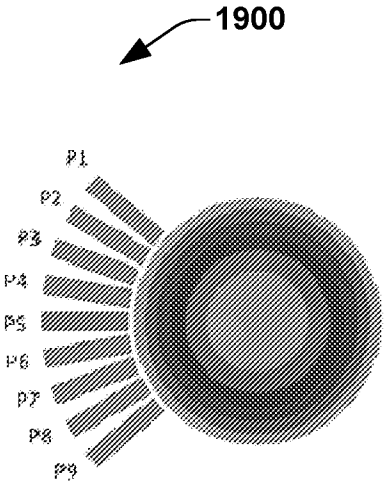
FIG. 19*b* illustrates a top-down view of the lens antenna system of FIG. 19*a*, according to one embodiment of the disclosure.
Figure 19A:
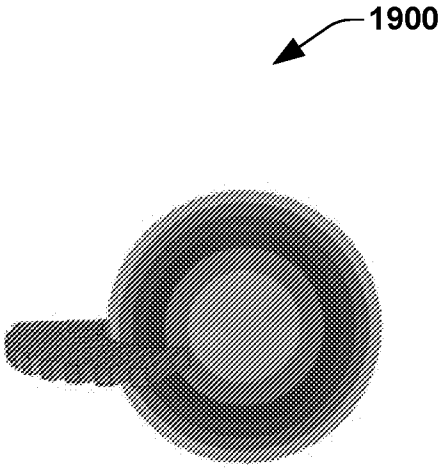
FIG. 19*a* illustrates a 3-dimensional (3D) view of an exemplary lens antenna system comprising waveguides of uniform cross-section, according to one embodiment of the disclosure.
Figure 19C:
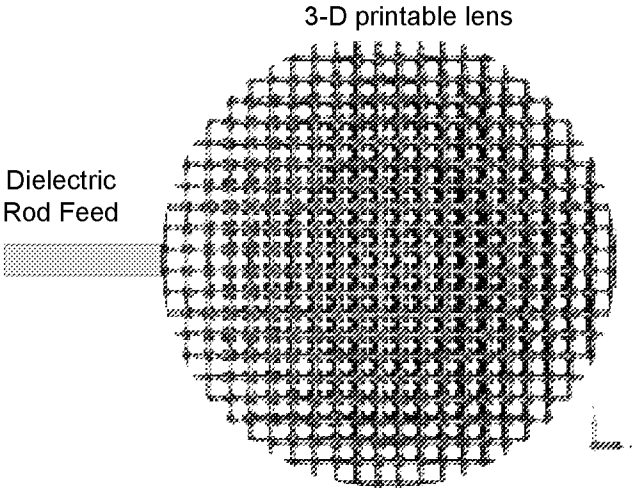
FIG. 19*c* illustrates an exemplary implementation of a 3-dimensional (3D) printable lens having unit cells of different filling factors, according to one embodiment of the disclosure.

In particular, in some embodiments, the mode launcher circuit is configured to convert electrical signals associated with the communication circuit 1807 to the electromagnetic waves. In some embodiments, the set of mode launcher circuits 1806$_1$ . . . 1806*m* is coupled respectively to the set of waveguides 1808$_1$ . . . 1808*m* and is configured to generate a respective set of electromagnetic waves, in order to excite the set of waveguides 1808$_1$ . . . 1808*m*. In some embodiments, the lens antenna system 1800 further comprises a beam switching network 1805 configured to provide one or more electrical signals 1809$_1$ . . . 1809*m* at the input of the mode launcher circuit, based on the communication signals 1810$_1$ . . . 1810*n* associated with the communication circuit 1807, at any instance. Therefore, at any instance, one or more waveguides of the set of waveguides 1808$_1$ . . . 1808*m* may be excited based on the one or more electrical signals 1809$_1$ . . . 1809*m* at the input of the mode launcher circuit. Consequently, at any instance, the lens 1804 is configured to receive electromagnetic waves from one or more waveguides associated with the set of waveguides 1808$_1$ . . . 1808*m* and provide one or more output antenna beams based thereon. In some embodiments, the lens 1804 may take any form including the Gradient Index Lens, traditional dielectric lens etc. In one embodiment, the lens 1804 may comprise a 3-dimensional (3D) printable lens having unit cells of different filling factors, as shown in FIG. 19*c*. In some embodiments, the beam switching network 1805 is configured to provide the one or more electrical signals of the set of electrical signals 1809$_1$ . . . 1809*m* at the input of the mode launcher circuit, in accordance with a predefined beam control algorithm 1803.

In some embodiments, the set of mode launcher circuits 1806$_1$ . . . 1806*m*, the beam switching network 1805 and the predefined beam control algorithm 1803 forms part of an excitation circuit (e.g., the excitation circuit 1706 in FIG. 1). In some embodiments, each waveguide of the set of waveguides 1808$_1$ . . . 1808*m* have a uniform cross-section all along, as depicted in FIG. 19*a* and FIG. 19*b*. In particular, FIG. 19*a* illustrates a 3-dimensional (3D) view of a lens antenna system 1900 comprising waveguides of uniform cross-section and FIG. 19*b* illustrates a top-down view of the lens antenna system 1900. In this embodiment, each waveguide of the set of waveguides associated with the lens antenna system 1900 is shown to have a uniform cross section in square shape. However, in other embodiments, other 3-dimensional (3D) shapes for the waveguides, for example, rectangular, cylindrical etc., are also contemplated to be within the scope of this disclosure.

Figure 20B:
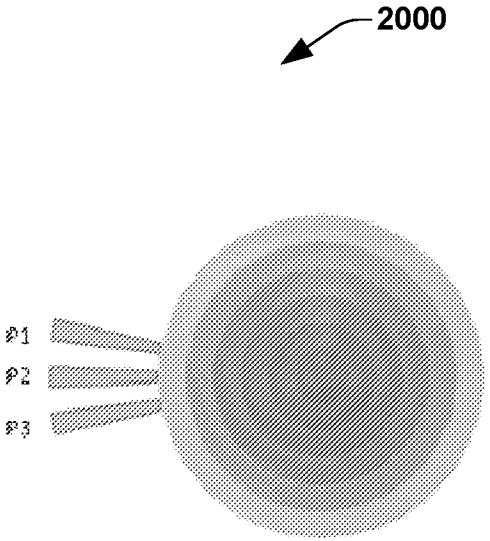
FIG. 20*a* and FIG. 20*b* illustrates an exemplary lens antenna system comprising waveguides of tapered cross-section, with the tapered end (i.e., the end with the smaller cross-section) coupled to the lens, according to one embodiment of the disclosure.
Figure 20A:
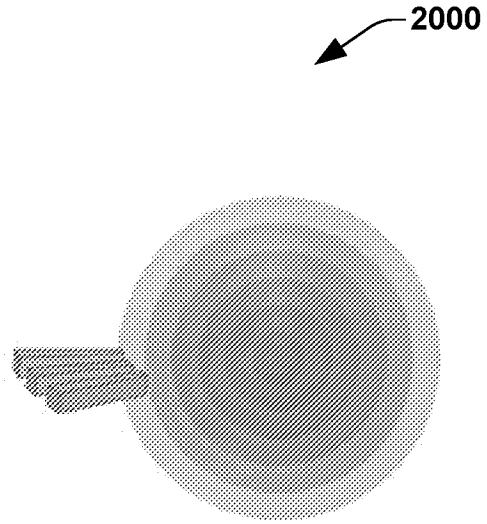

Alternately, in other embodiments, each waveguide of the set of waveguides 1808$_1$ . . . 1808*m* comprises a non-uniform cross-section, as depicted in FIG. 20*a* and FIG. 20*b*. In particular, FIG. 20*a* and FIG. 20*b* illustrates a lens antenna system 2000 comprising waveguides of tapered cross-section, with the tapered end (i.e., the end with the smaller cross-section) coupled to the lens. In this embodiment, each waveguide of the set of waveguides associated with the lens antenna system 2000 is shown to have a uniform cross section in square shape. However, in other embodiments, other 3-dimensional (3D) shapes for the waveguides, for example, rectangular, cylindrical etc., are also contemplated to be within the scope of this disclosure. In some embodiments, the waveguides having non-uniform cross sections towards the lens (i.e., tapered towards the lens), offers broad impedance matching at the interface between mode launcher and the tapered rod feed. In some embodiments, the cross section of the waveguides (in FIG. 18, FIG. 19*a-b* and FIG. 20*a-b*) is kept within subwavelength to force an evanescent wave propagation mode on the transverse plane to the direction of propagation. Further, in other embodiments, other non-uniform cross-sections of the lens (different from the tapered design with the tapered end coupled to the lens) is also contemplated to be within the scope of this disclosure.

Figure 21C:
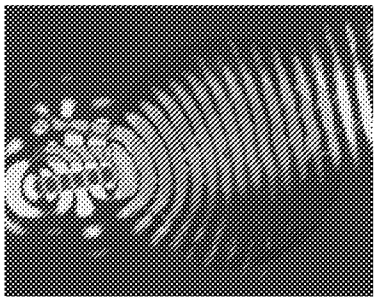
FIG. 21*a*, FIG. 21*b* and FIG. 21*c* illustrates beam scanning based on exciting dielectric rods (or waveguides) of uniform cross-section, one at a time, according to one embodiment of the disclosure.
Figure 21B:
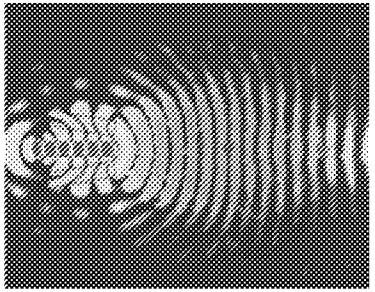
Figure 21A:
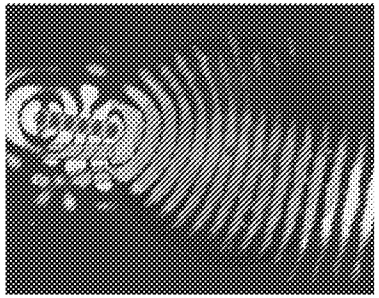
Figure 22A:
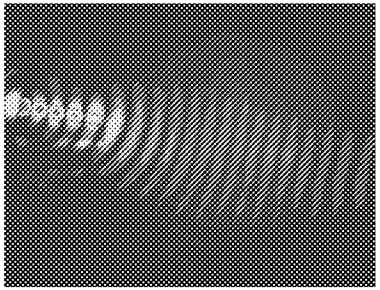
FIG. 22*a*, FIG. 22*b* and FIG. 22*c* illustrates beam scanning based on exciting dielectric rods (or waveguides) of tapered cross-section, one at a time, according to one embodiment of the disclosure.
Figure 22B:
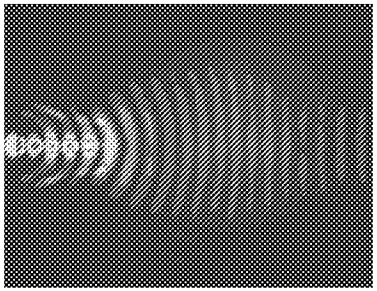
Figure 22C:
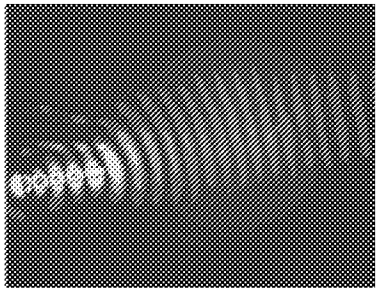
Figure 24:
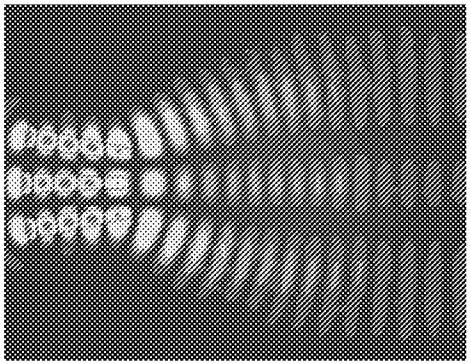
FIG. 24 illustrates tri-beam tracing with a tapered dielectric rods (or waveguides), according to one embodiment of the disclosure.
Figure 23:
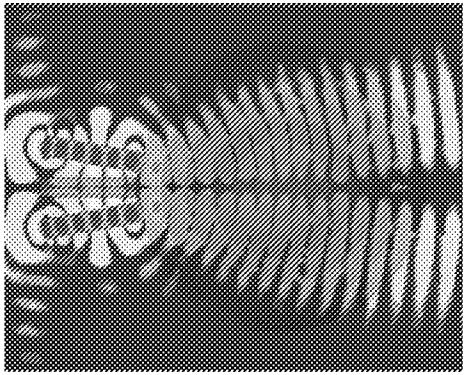
FIG. 23 illustrates dual beam ray tracing based on exciting two dielectric rods (or waveguides) of uniform cross-section, according to one embodiment of the disclosure.

In some embodiments, utilizing the set of waveguides (e.g., the set of waveguides 1808$_1$ . . . 1808*m* in FIG. 18) in lens antenna systems enables to achieve beam forming and beam steering based on exciting one waveguide at a time. In particular, FIG. 21*a*, FIG. 21*b* and FIG. 21*c* illustrates beam scanning based on exciting dielectric rods (or waveguides) of uniform cross-section, one at a time. Further, FIG. 22*a*, FIG. 22*b* and FIG. 22*c* illustrates beam scanning based on exciting dielectric rods (or waveguides) of tapered cross-section, one at a time. Besides the steering capability, utilizing the set of waveguides (e.g., the set of waveguides 1808$_1$ . . . 1808*m* in FIG. 18) in lens antenna systems allows straightforward multi-beam generation. In particular, FIG. 23 illustrates dual beam ray tracing based on exciting two dielectric rods (or waveguides) of uniform cross-section. In this configuration, the two rods are excited simultaneously without phase shifters. In other embodiments, two or more rods or waveguides may be excited simultaneously to achieve multi-beam generation. Further, FIG. 24 illustrates tri-beam tracing with tapered dielectric rods (or waveguides). In this configuration, three tapered dielectric rods are excited simultaneously without phase shifters. In other embodiments, two or more rods or waveguides may be excited simultaneously to achieve multi-beam generation.

Figure 25:
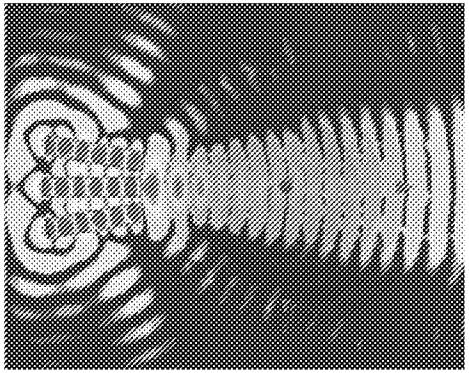
FIG. 25 illustrates beam broadening based on utilizing waveguides of uniform cross-section, according to one embodiment of the disclosure.

In some embodiments, utilizing the set of waveguides (e.g., the set of waveguides 1808$_1$ . . . 1808*m* in FIG. 18) in lens antenna systems enables to achieve beam broadening capability to address various application scenarios, based on exciting multiple rods (e.g., two or more waveguides), as illustrated in FIG. 25. In particular, FIG. 25 illustrates beam broadening based on utilizing waveguides of uniform cross-section. However, in other embodiments, beam broadening may be achieved based on utilizing waveguides of non-uniform cross-section, for example, tapered cross-section. In such embodiments, the lens (e.g., the lens 1804 in FIG. 18) is configured to provide a single output beam based on the electromagnetic waves associated with the two or more waveguides. In some embodiments, by exciting multiple waveguides or rods for beam broadening, the side-lobe level of the broaden beam is lowered than that of the narrower beam case without putting any effort in controlling the trade-off between directivity and side-lobe level.

Figure 26B:
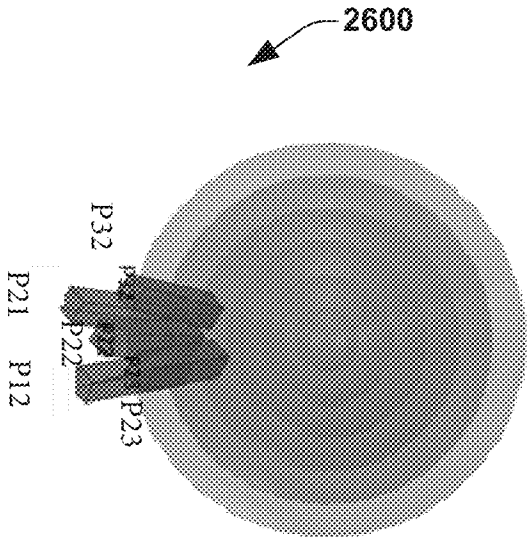
FIG. 26*a* and FIG. 26*b* illustrates an exemplary lens antenna system where a set of waveguides are arranged both in the azimuth plane and the elevation plane with respect to the lens, according to one embodiment of the disclosure.
Figure 26A:
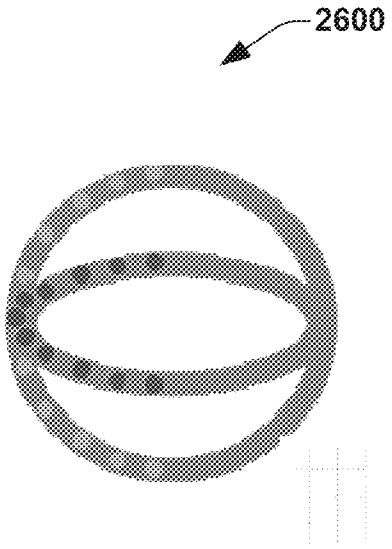

Referring back to FIG. 18, in some embodiments, the set of waveguides (e.g., the set of waveguides 1808$_1$ . . . 1808*m* in FIG. 18) in lens antenna systems are arranged in the azimuth plane with respect to the lens, as illustrated in in FIG. 18, FIG. 19*a-b* and FIG. 20*a-b* above. However, in other embodiments, the set of waveguides (e.g., the set of waveguides $\mathbf{1808}_1$ . . . 1808*m* in FIG. 18) in lens antenna systems may be arranged in the elevation plane with respect to the lens. Alternately, in some embodiments, the set of waveguides (e.g., the set of waveguides $\mathbf{1808}_1$ . . . 1808*m* in FIG. 18) in lens antenna systems are arranged both in the azimuth plane and the elevation plane with respect to the lens, as illustrated in FIG. 26*a* and FIG. 26*b*. In particular, FIG. 26*a* and FIG. 26*b* illustrates a lens antenna system 2600 where a set of waveguides are arranged both in the azimuth plane and the elevation plane with respect to the lens. In some embodiments, arranging the set of waveguides in both the azimuth plane and the elevation plane with respect to the lens, enables to achieve dual plane ray tracing.

Figure 27B:
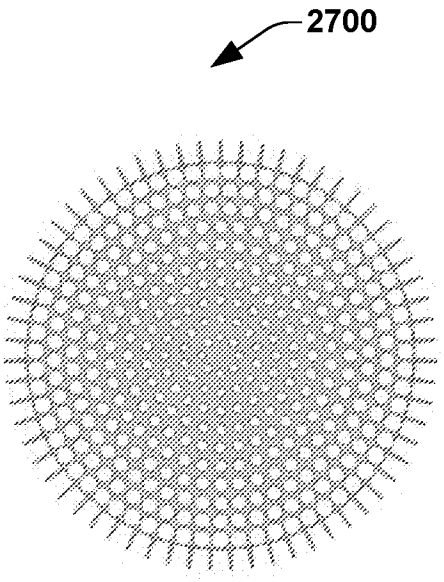
FIG. 27*a* and FIG. 27*b* illustrates an exemplary lens antenna system comprising a perforated lens, according to one embodiment of the disclosure.
Figure 27A:
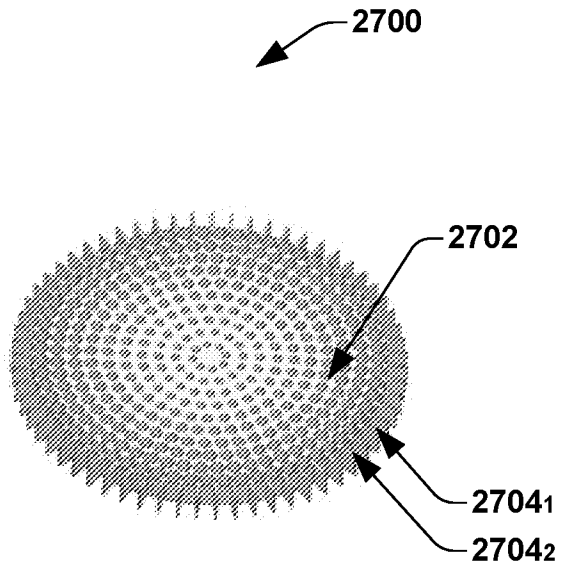

Referring back to FIG. 18, in some embodiments, the lens 1804 comprises a perforated structure, as shown in FIG. 27*a* and FIG. 27*b*. In some embodiments, FIG. 27*a* and FIG. 27*b* illustrates a lens antenna system 2700 comprising a perforated lens, according to one embodiment of the disclosure. In particular, FIG. 27*a* illustrates a 3D view of the lens antenna system 2700 and FIG. 27*b* illustrates a top-down view of the lens antenna system 2700. In some embodiments, the lens antenna system 2700 comprises one possible way of implementation of the lens antenna system 1800 in FIG. 18. Referring to FIG. 27*a*, the lens antenna system 2700 comprises a lens 2702 and a waveguide array comprising a set of waveguides $\mathbf{2704}_1$, $\mathbf{2704}_2$ etc. arranged along the circumference of the lens 2702. In this embodiment, the set of waveguides $\mathbf{2704}_1$, $\mathbf{2704}_2$ etc. are shown to be arranged all along the circumference of the lens 2702. However, in other embodiments, the set of waveguides $\mathbf{2704}_1$, $\mathbf{2704}_2$ etc. may be arranged only along a part of the circumference of the lens 2702.

In some embodiments, the lens 2702 comprises a perforated structure. In some embodiments, the perforations associated with the lens 2702 have a predefined symmetry associated therewith. In some embodiments, the set of waveguides $\mathbf{2704}_1$, $\mathbf{2704}_2$ etc. are arranged conformal to the shape of the lens 2702. In this embodiment, the lens 2702 comprises a cylindrical shape. However, in other embodiments, the lens 2702 may comprise any different shape. Further, in this embodiment, the set of waveguides $\mathbf{2704}_1$, $\mathbf{2704}_2$ etc. are shown to have a spike like structure. However, in other embodiments, the set of waveguides $\mathbf{2704}_1$, $\mathbf{2704}_2$ etc. may be implemented in any different form that is conformal to the lens 2702. In some embodiments, the set of waveguides $\mathbf{2704}_1$, $\mathbf{2704}_2$ etc. are directly integrated (or directly connected) to the lens. However, in other embodiments, the set of waveguides $\mathbf{2704}_1$, $\mathbf{2704}_2$ etc. may be indirectly coupled to the lens 2702.

Referring back to FIG. 18, in some embodiments, the set of waveguides $\mathbf{1808}_1$ . . . 1808*m* comprises a set of field confined and impedance controlled waveguides. In particular, in some embodiments, each waveguide of the set of waveguides $\mathbf{1808}_1$ . . . 1808*m* has its refraction index varying both radially and axially as given by Equation (3) below:

$$n(x, y, z) = \left[a\left(x^2 + y^2\right) + f\right] * \frac{1}{\sigma\sqrt{2\pi}} e^{-z^2/2\sigma^2} \tag{3}$$

In some embodiments, the radial refraction index of the set of waveguides $\mathbf{1808}_1$ . . . 1808*m* convolutes with Gaussian refraction index variation along axial direction. In some embodiments, the refractive index of the waveguide is varied based on mixing different materials to form the waveguides. Alternately, in other embodiments, the refractive index may be varied by adding air holes of different sizes in a homogenous material that forms the waveguide. However, other methods of forming waveguides with varying refractive index are also contemplated to be within the scope of this disclosure. In some embodiments, the slow variant Gaussian refraction index in axial direction towards the lens (e.g., the lens 1804 in FIG. 18) emulates the tapering for a better impedance matching while avoiding the delicateness of the tapered waveguide. In some embodiments, the set of field confined and impedance controlled waveguides comprises cylindrical waveguides. However, in other embodiments, the set of field confined and impedance controlled waveguides comprises cylindrical waveguides may comprise any different shape. Further, in some embodiments, the set of field confined and impedance controlled waveguides comprises dielectric waveguides made of dielectric material. However, in other embodiments, the set of field confined and impedance controlled waveguides may be implemented differently.

Figure 28:
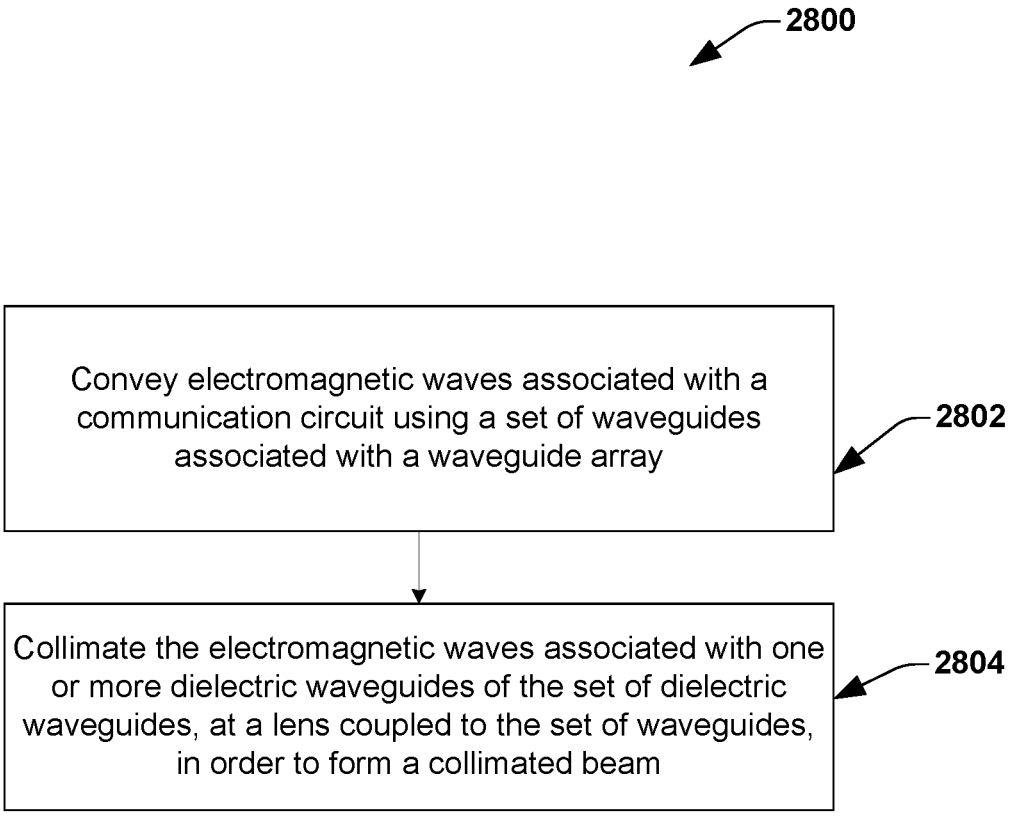
FIG. 28 illustrates a flow chart of a method for a lens antenna system comprising a waveguide array, according to one embodiment of the disclosure.

FIG. 28 illustrates a flow chart of a method 2800 for an exemplary lens antenna system, according to one embodiment of the disclosure. The method 2800 is explained herein with reference to the lens antenna system 1800 in FIG. 18. However, the method 2800 is equally applicable to the lens antenna systems 1900, 2000, 2600 and 2800 in FIG. 19*a-b*, FIG. 20*a-b*, FIG. 26*a-b* and FIG. 27*a-b*, respectively. At 2802, electromagnetic waves associated with a communication circuit (e.g., the communication circuit 1807 in FIG. 18) is conveyed using one or more waveguides of a set of waveguides (e.g., the set of waveguides $\mathbf{1808}_1$ . . . 1808*m* in FIG. 18) associated with a waveguide array. In some embodiments, the set of waveguides comprises a set of dielectric waveguides made of dielectric material. At 2804, the electromagnetic waves associated with the one or more waveguides of the set of waveguides is received at a lens (e.g., the lens 1804 in FIG. 18) coupled to the set of waveguides, in order to provide one or more output antenna beams based thereon. In some embodiments, the set of waveguides associated with the waveguide array is directly connected/coupled to the lens. However, in other embodiments, the set of waveguides associated with the waveguide array may be indirectly coupled to the lens (e.g., placed close to one another and coupled via the electromagnetic waves).

In some embodiments, each waveguide of the set of waveguides associated with the waveguide array has a uniform cross-section all along, as depicted in FIG. 19*a* and FIG. 19*b*. Alternately, in other embodiments, each waveguide of the set of waveguides associated with the waveguide array has a non-uniform cross-section (e.g., tapered cross-section), as depicted in FIG. 20*a* and FIG. 20*b*. In some embodiments, the set of waveguides associated with the waveguide array is arranged in the azimuth plane with respect to the lens, as illustrated in in FIG. 18, FIG. 19*a-b* and FIG. 20*a-b* above. However, in other embodiments, the set of waveguides associated with the waveguide array may be arranged in the elevation plane with respect to the lens. Alternately, in some embodiments, the set of waveguides associated with the waveguide array is arranged both in the azimuth plane and the elevation plane with respect to the lens, as illustrated in FIG. 26*a* and FIG. 26*b*.

In some embodiments, the lens (e.g., the lens 1804 in FIG. 18) comprises a perforated structure, as shown in FIG. 27*a* and FIG. 27*b*. In such embodiments, the perforations associated with the lens have a predefined symmetry associated therewith. In such embodiments, the set of waveguides associated with the waveguide array is arranged conformal to the shape of the lens (having the perforated structure). Furthermore, in some embodiments, the set of waveguides associated with the waveguide array comprises a set of field confined and impedance controlled waveguides. In particular, in some embodiments, each waveguide of the set of waveguides associated with the waveguide array has its refraction index varying both radially and axially as given by Equation (3) above.

Figure 29:
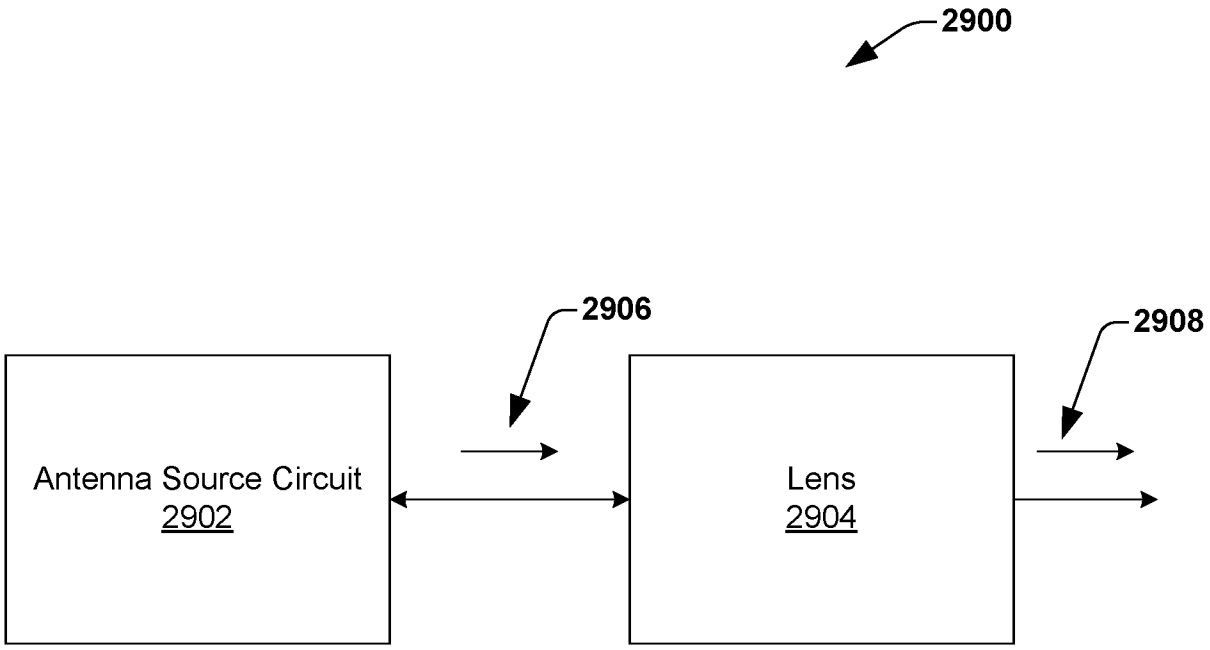
FIG. 29 illustrates a simplified block diagram of an exemplary lens antenna system that supports 2-dimensional (2D) beam steering, according to one embodiment of the disclosure.

FIG. 29 illustrates a simplified block diagram of an exemplary lens antenna system 2900 that supports 2-dimensional (2D) beam steering, according to one embodiment of the disclosure. In some embodiments, the lens antenna system 2900 may be part of wireless communication systems, for example, mmW systems. Further, in some embodiments, the lens antenna system 2900 may be part of radar systems. In some embodiments, the lens antenna system 2900 comprises an antenna source circuit 2902 and a lens 2904. In some embodiments, the antenna source circuit 2902 may be part of a radio frequency front end module (RFEM) and the lens 2904 may be mounted on top of the RFEM. In some embodiments, the lens 2904 comprises a passive component. However, the invention also contemplates the lens 2904 to include active configurations, in some embodiments that would allow dynamic reconfiguration of the lens 2904. In some embodiments, the antenna source circuit 2902 is configured to provide an antenna source beam 2906 to the lens 2904. In some embodiments, the lens 2904 is configured to receive the antenna source beam 2906 and provide an output beam 2908, based on the received antenna source beam 2906. In some embodiments, the lens 2904 is configured to reduce main-beam beamwidth associated with the received antenna source beam 2906, thereby enhancing the gain of the lens antenna system 2900.

In some embodiments, the received antenna source beam 2906 comprises a phase delay profile associated therewith. In some embodiments, the phase delay profile associated with the received antenna beam 2906 defines a phase delay associated with the received antenna source beam 2906 at different locations on the lens. In some embodiments, the lens 2904 is configured to provide a phase compensation to the received antenna source beam 2906, in accordance with a phase compensation profile associated with the lens 2904, prior to providing the output beam 2908. In some embodiments, the phase compensation profile associated with the lens 2904 defines a phase compensation provided by the lens to the received antenna source beam 2906 at the different locations of the lens. In some embodiments, the phase compensation profile of the lens 2904 is configured in a way that the lens 2904 provides 2-dimensional (2D) beam steering, further details of which are given in an embodiment below.

In some embodiments, a lens that provides 2D beam steering refers to a lens that steers an output beam (e.g., the output beam 2908), in accordance with (or aligned to) a beam steering direction of its corresponding antenna source beam (e.g., the antenna source beam 2906). In some embodiments, the lens 2904 comprises a planar lens. However, in other embodiments, the lens 2904 may be implemented differently from a planar lens. In some embodiments, the lens 2904 may comprise any shape, rectangular, circular etc. In some embodiments, the lens 2904 may be made of any material, for example, plastic, dielectric etc. In some embodiments, the lens 2904 is separated from the antenna source circuit 2902 by a distance, for example, an airgap. In some embodiments, the antenna source circuit 2902 comprises a phased antenna array (PAA) circuit that has beam steering capability. However, in other embodiments, the antenna source circuit 2902 may comprise any type of antenna circuits (may or may not have beam steering capability), for example horn antenna.

Figure 30:
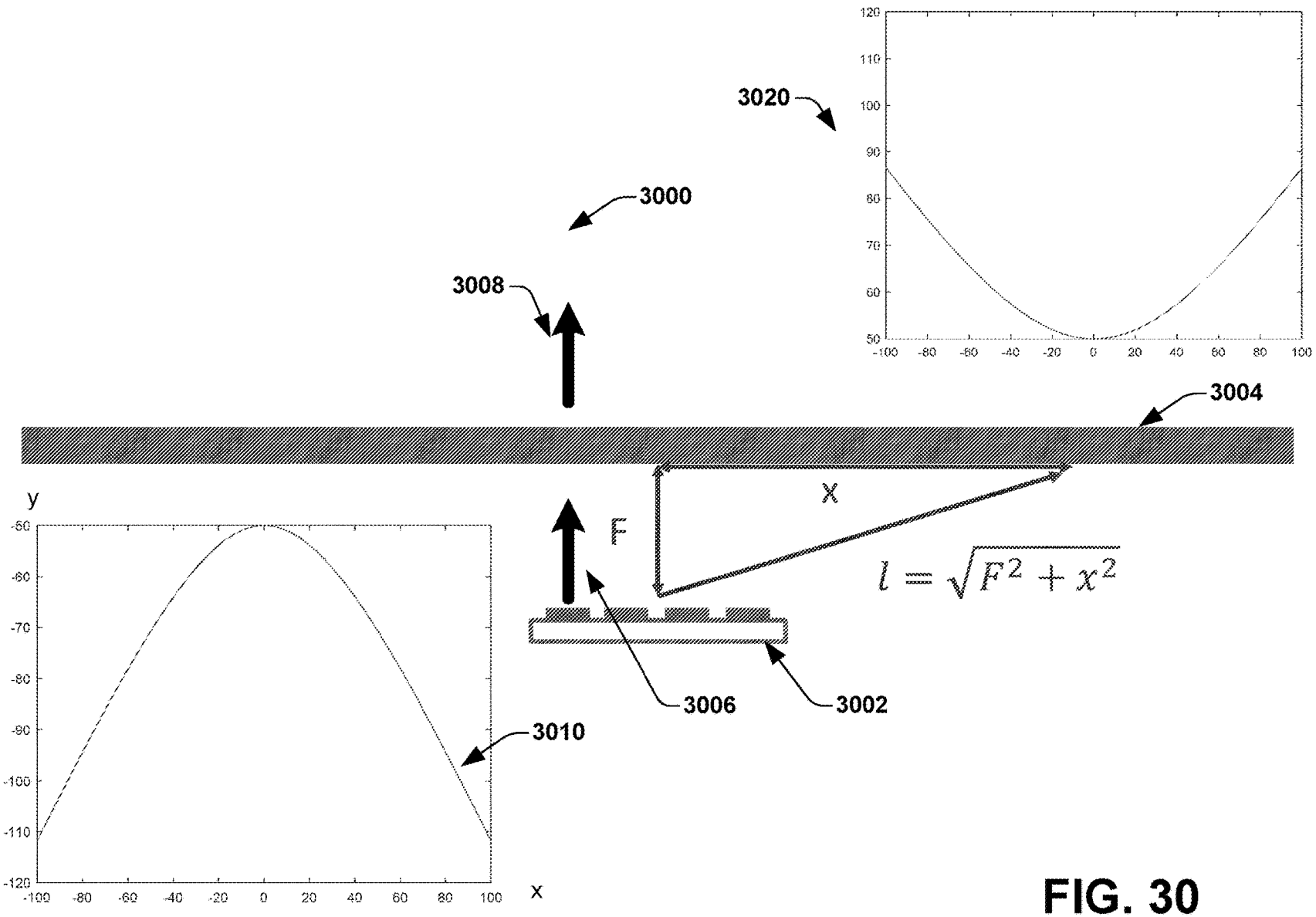
FIG. 30 illustrates an example implementation of a lens antenna system that supports 2D beam steering, according to one embodiment of the disclosure.

FIG. 30 illustrates an example implementation of a lens antenna system 3000 that supports 2D beam steering, according to one embodiment of the disclosure. In some embodiments, the lens antenna system 3000 comprises one possible way of implementation of the lens antenna system 2900 in FIG. 29. The lens antenna system 3000 comprises an antenna source circuit 3002 and a lens 3004. In this embodiment, the antenna source circuit 3002 comprises a phased array antenna (PAA) circuit and the lens 3004 comprises a planar lens. However, in other embodiments, the antenna source circuit 3002 and the lens 3004 may be implemented differently. In some embodiments, the antenna source circuit 3002 is configured to provide an antenna source beam 3006 to the lens 3004. In some embodiments, the lens 3004 is configured to receive the antenna source beam 3006 and provide an output beam 3008, based on the received antenna source beam 3006.

In some embodiments, a distance travelled by the antenna source beam 3006 to reach different locations on the lens is different, as can be seen in FIG. 30. Therefore, in some embodiments, a phase delay associated with the antenna source beam at the different locations on the lens is different, as defined by a phase delay profile 3010 of the antenna source beam 3006. In some embodiments, x-axis of the phase delay profile 3010 illustrates the different locations on the lens 3004 and the y-axis illustrates the phase delay of the antenna source beam 3006 at the different locations on the lens 3004. In some embodiments, the phase delay profile 3010 is determined based on a predefined location of the antenna source circuit 3002 and the lens 3004 with respect to one another.

In some embodiments, the lens 3004 is configured to provide a phase compensation to the received antenna source beam 3006, in accordance with a phase compensation profile 3020 associated with the lens 3004, prior to providing the output beam 3008. In some embodiments, the phase compensation profile 3020 associated with the lens 3004 defines a phase compensation provided by the lens 3004 to the received antenna source beam 3006 at the different locations of the lens 3004. In some embodiments, the phase compensation profile 3020 of the lens 3004 is configured in a way that the lens 3004 provides 2-dimensional (2D) beam steering. In some embodiments, a lens that provides 2D beam steering refers to a lens that steers an output beam (e.g., the output beam 3008), in accordance with (or aligned to) a beam steering direction of its corresponding antenna source beam (e.g., the antenna source beam 3006).

Figure 31:
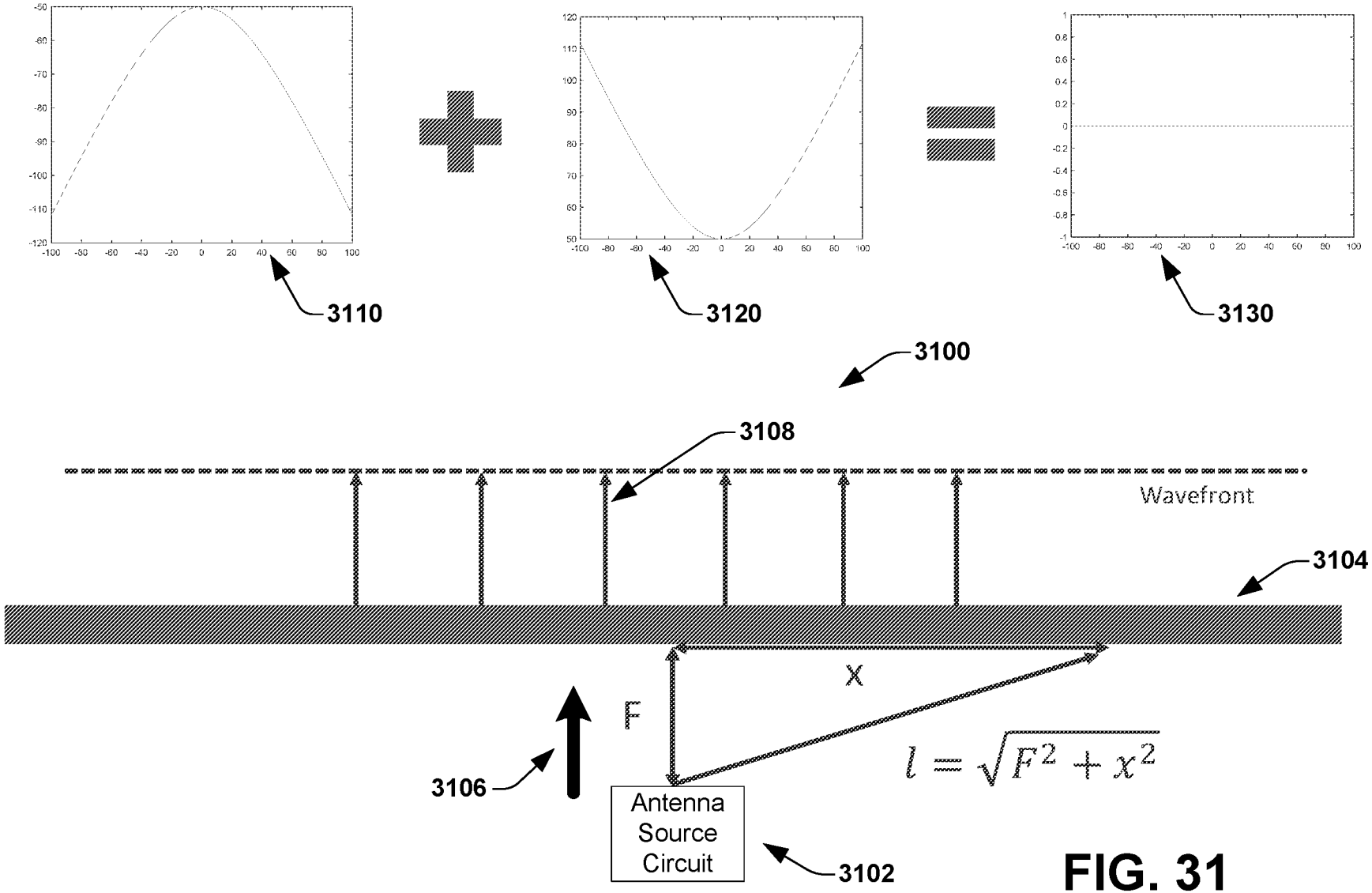
FIG. 31 illustrates an exemplary lens antenna system where the phase compensation profile of the lens is configured to fully compensate the phase delay associated with the received antenna source beam at the different locations of the lens (defined by the phase delay profile of the antenna source beam).

In some embodiments, the phase compensation profile 3020 of the lens 3004 is configured in a way that the phase delay associated with the received antenna source beam 3006 at the different locations of the lens, defined by the phase delay profile 3010 of the antenna source beam 3006, is not fully compensated at the lens 3004, in order to provide the 2D beam steering. In some embodiments, if the phase compensation profile of the lens 3004 is configured to fully compensate the phase delay associated with the received antenna source beam 3006 at the different locations of the lens, 2D beam steering may not be supported by the lens 3004. In particular, FIG. 31 illustrates a lens antenna system 3100 where the phase compensation profile 3120 of the lens 3104 is configured to fully compensate the phase delay associated with the received antenna source beam 3106 at the different locations of the lens 3104 (defined by the phase delay profile 3110 of the antenna source beam 3106). As can be seen, the phase compensation profile 3120 of the lens 3104 is an exact inverse of the phase delay profile 3110 of the antenna source beam 3106, which results in full compensation of the phase delay associated with the received antenna source beam 3106 at the different locations of the lens 3104. In such embodiments, the output beam 3108 comprises a collimated beam. In such embodiments, the output beam 3108 comprises a phase delay profile 3130 that is a constant or zero at all locations on the lens. Therefore, in such embodiments, the output beam 3108 is always steered in the same direction irrespective of the beam steering direction of the antenna source beam 3106. In other words, in such embodiments, the lens 3104 does not provide beam steering for output beam 3108.

Figure 32A:
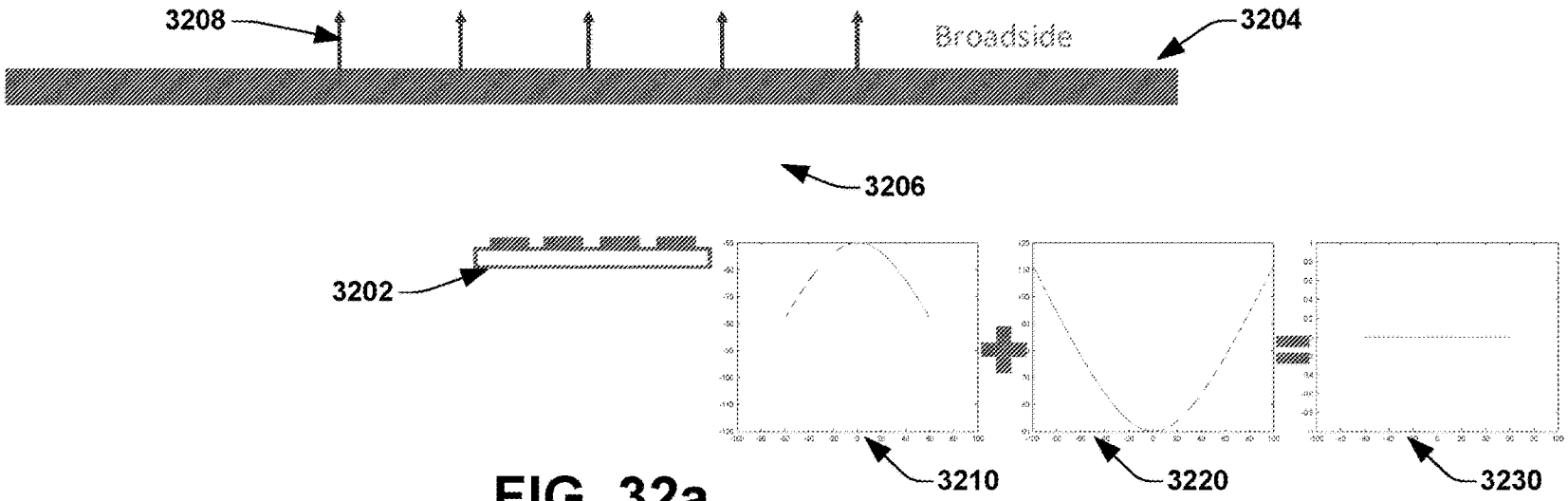
FIG. 32*a* and FIG. 32*b* illustrates an exemplary lens antenna system comprising a lens that provides only 10 beam steering.
Figure 32B:
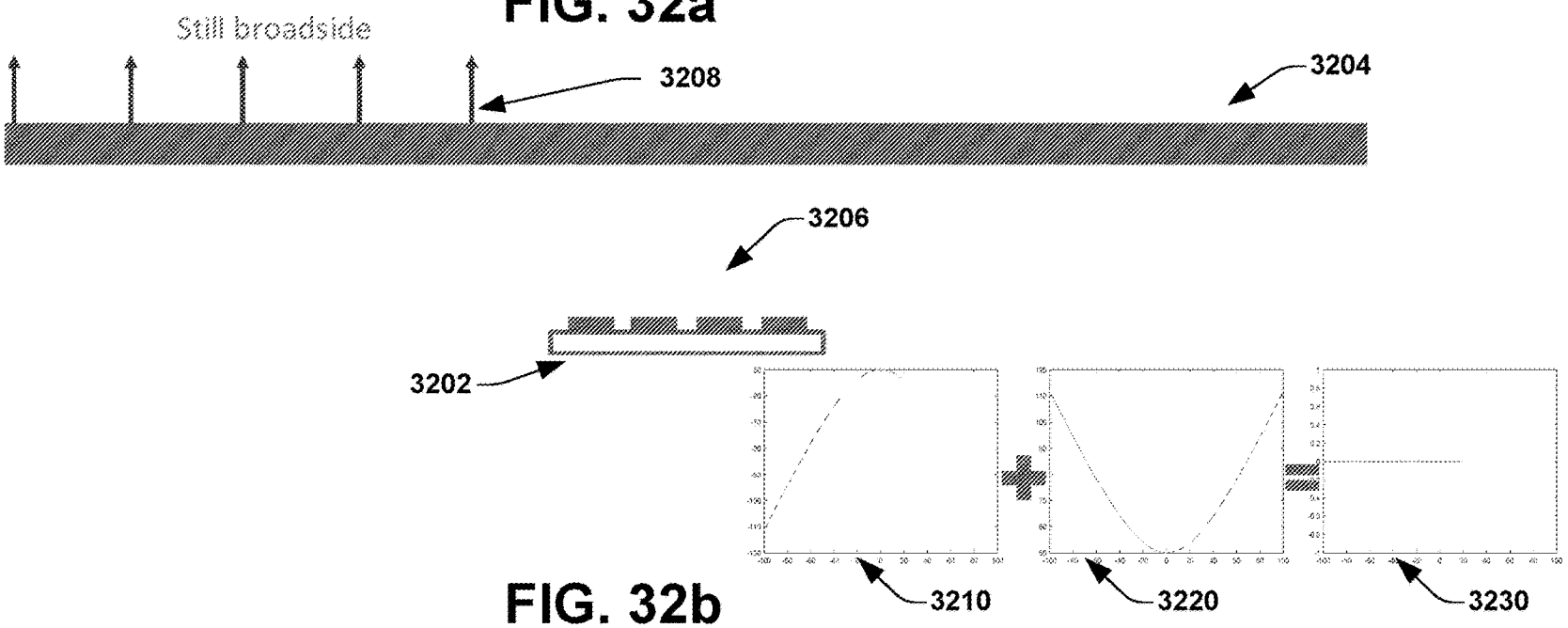

FIG. 32*a* and FIG. 32*b* illustrates an exemplary lens antenna system 3200 comprising a lens 3204 that does not provide beam steering for output beam and a phased antenna array (PAA) circuit 3202 as the antenna source circuit. In some embodiments, the PAA circuit 3202 has beam steering capability. As can be seen in FIG. 32*a* and FIG. 32*b*, the phase compensation profile 3220 of the lens 3204 is configured to fully compensate the phase delay associated with the received antenna source beam 3206 at the different locations of the lens 3204 (defined by the phase delay profile 3210 of the antenna source beam 3206). Therefore, in this embodiment, an antenna source beam 3206 in FIG. 32*a* towards the broadside is steered by the lens 3204 in the broadside direction, based on the phase compensation profile 3230 of the lens 3204. Further, an antenna source beam 3206 in FIG. 32*b* towards the left side is also steered by the lens 3204 in the broadside direction, based on the phase compensation profile 3230 of the lens 3204, thereby providing only an output beam 3208 with fixed beam direction.

Referring back to FIG. 30, therefore, in some embodiments, the phase compensation profile 3020 of the lens 3004 is configured not to be an exact inverse of the phase delay profile 3010 of the antenna source beam 3006, in order to provide less than a full compensation (or partial compensation) to the received antenna source beam 3006. Further, in some embodiments, the phase compensation profile 3020 of the lens 3004 is configured in a way that a phase delay profile of the output beam 3008 resembles the phase delay profile 3010 of the input beam 3006, in order to provide the 2D beam steering, as explained further below with reference to FIG. 33*a* and FIG. 33*b*. In some embodiments, utilizing the lens 3004 along with the antenna source circuit 3002 leads to a trade-off between gain enhancement and a maximum scan angle of the antenna source circuit 3002. In particular, in some embodiments, utilizing the lens 3004 leads to a gain enhancement of the antenna source circuit 3002, however, the maximum scan angle of the antenna source circuit 3002 is reduced, as shown in table 3500 in FIG. 35. As can be seen in the table 3500 in FIG. 35, lens models 5067*a*, 5067, 6060 and 7090 provides higher gain (see column 3502) with respect to the case the lens is not used, that is, RFEM only (see row 3510). However, lens models 5067*a*, 5067, 6060 and 7090 provides lower scan angles (see columns 3504 and 3506) with respect to the case the lens is not used, that is, RFEM only (see row 3510).

Figure 34A:
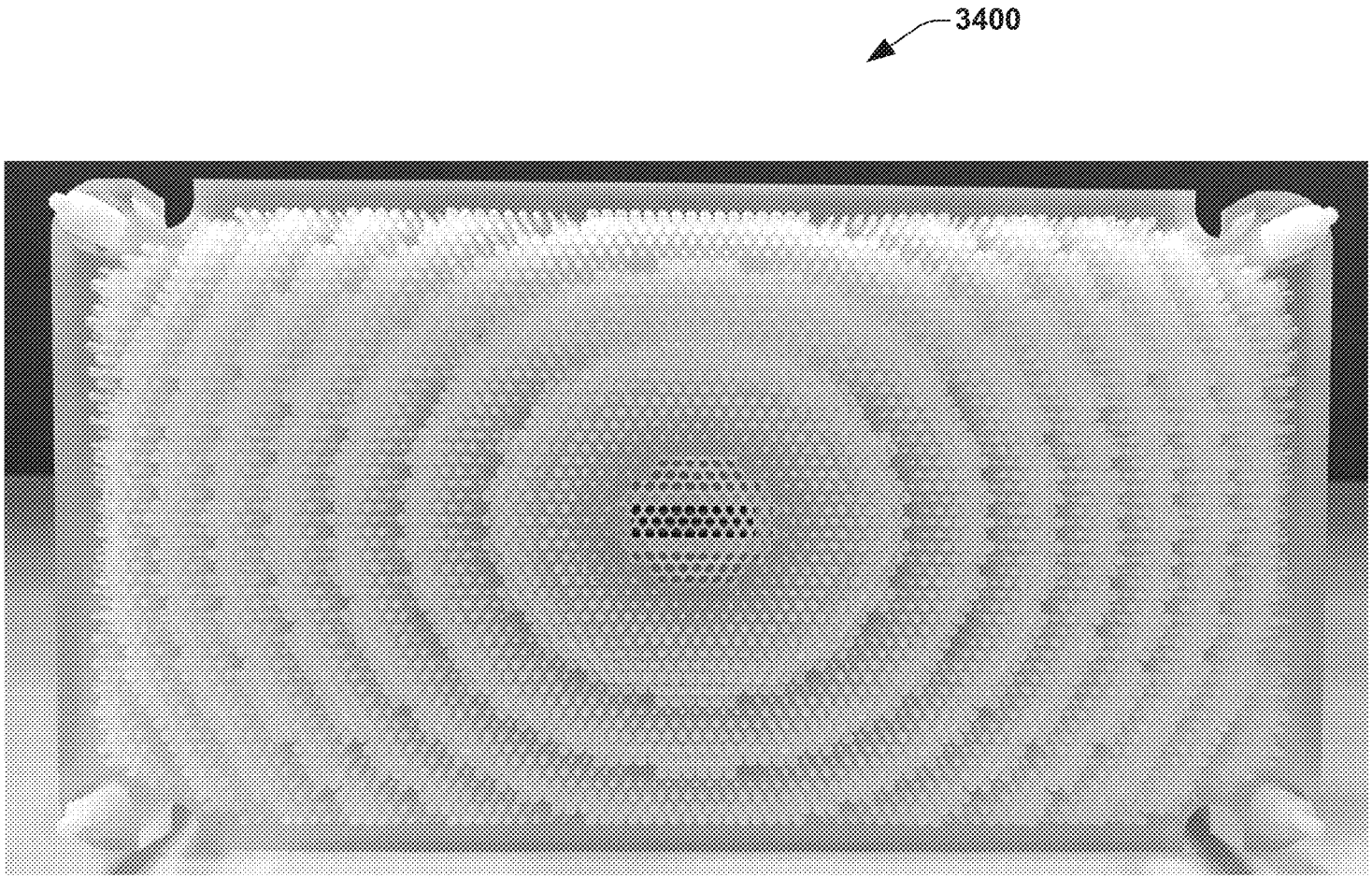
FIG. 34*a* illustrates an exemplary lens comprising a plurality of unit cells, according to one embodiment of the disclosure.

In some embodiments, a design/geometry of the lens 3004 is modified, based on the phase delay profile 3010 of the antenna source beam 3006, in order to realize the phase compensation profile 3020 of the lens 3004. In some embodiments, the lens 3004 comprises a plurality of unit cells, as illustrated in FIG. 34*a*. In some embodiments, the plurality of unit cells may be arranged in a hexagonal lattice arrangement, as illustrated in FIG. 34*a*. However, other arrangements of unit cells are also contemplated to be within the scope of this disclosure. In such embodiments, a geometry of a set of unit cells of the plurality of unit cells is modified, based on the phase delay profile 3010 of the antenna source beam 3006, in order to realize the phase compensation profile 3020 of the lens 3004. In some embodiments, each unit cell of the plurality of unit cells comprises a through hole associated therewith. In some embodiments, modifying the geometry of a set of unit cells comprises varying a diameter of the through hole associated with the set of unit cells. FIG. 34*a* illustrates a lens 3400, according to one embodiment of the disclosure. In some embodiments, the lens 3400 in FIG. 34*a* comprises one possible way of implementation of the lens 3004 in FIG. 30 or the lens 2904 in FIG. 29.

Figure 34B:
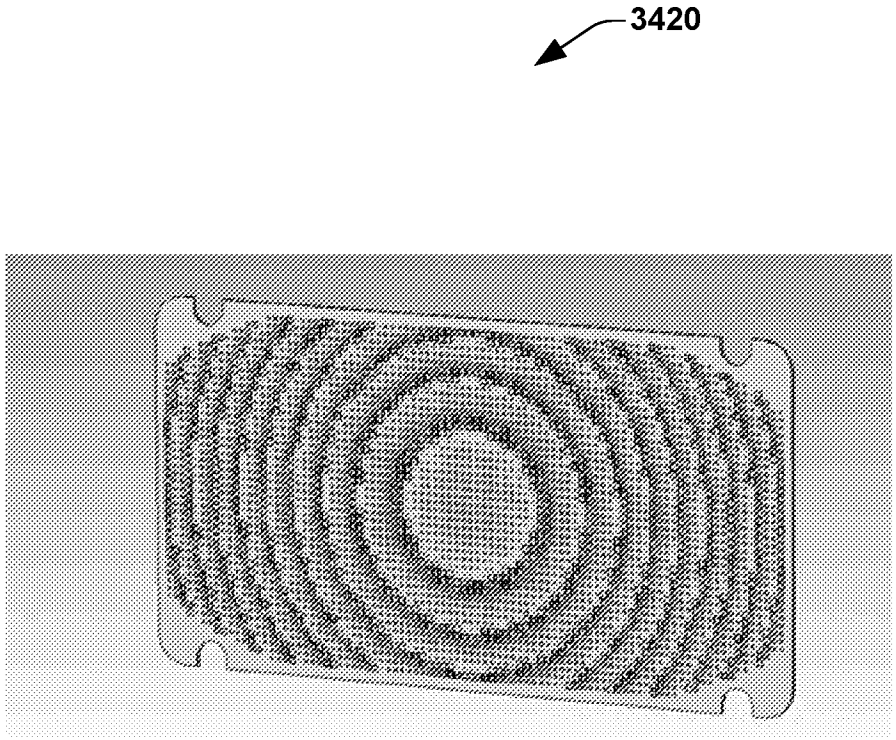
FIG. 34*b* illustrates an exemplary printed circuit board (PCB) lens, according to one embodiment of the disclosure.
Figure 34C:
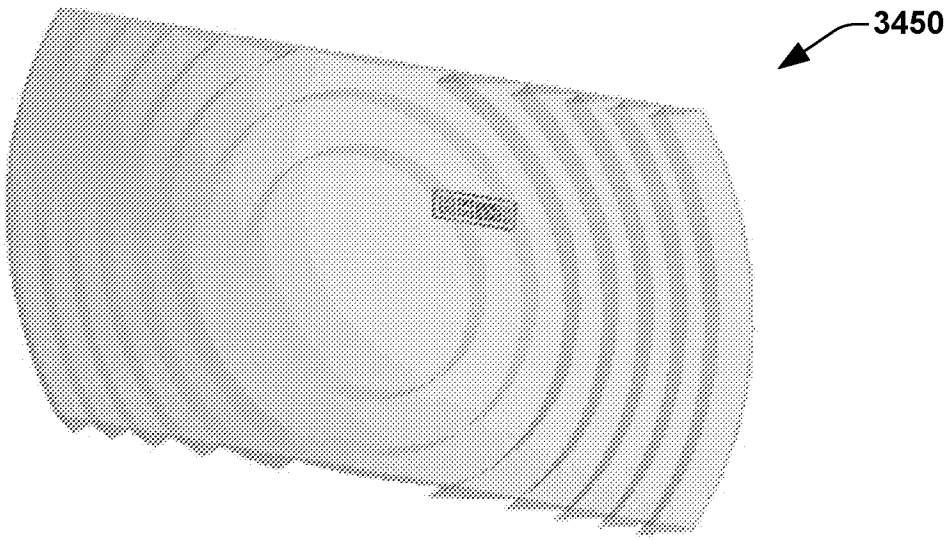
FIG. 34*c* and FIG. 34*d* illustrates an exemplary zone plate lens, according to one embodiment of the disclosure.
Figure 34D:
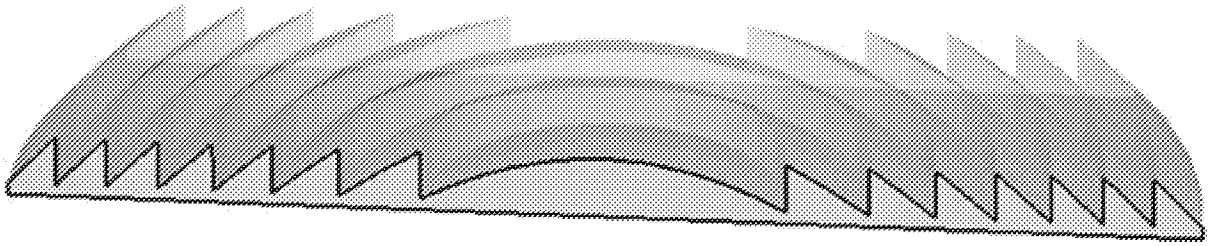

Alternately, in some embodiments, the lens 3004 in FIG. 30 may be implemented as a printed circuit board (PCB) lens 3420 comprising a plurality of unit cells, as illustrated in FIG. 34*b*. In some embodiments, the plurality of unit cells may be arranged in a rectangular lattice arrangement, as illustrated in FIG. 34*b*. However, other arrangements of unit cells are also contemplated to be within the scope of this disclosure. In such embodiments, a geometry of a set of unit cells of the plurality of unit cells is modified, based on the phase delay profile 3010 of the antenna source beam 3006, in order to realize the phase compensation profile 3020 of the lens 3004. Referring back to FIG. 30, further, in some embodiments, the lens 3004 may be implemented as a zone plate lens 3450 comprising a plurality of zone plates, as illustrated in FIG. 34*c* and FIG. 34*d*. In such embodiments, an arrangement or design of the zone plates (e.g., the curvature, the width, the height etc. of the zone plates) is modified, based on the phase delay profile 3010 of the antenna source beam 3006, in order to realize the phase compensation profile 3020 of the lens 3004. Furthermore, other implementations of the lens 3004 in FIG. 30 are also contemplated to be within the scope of this disclosure.

Figure 33A:
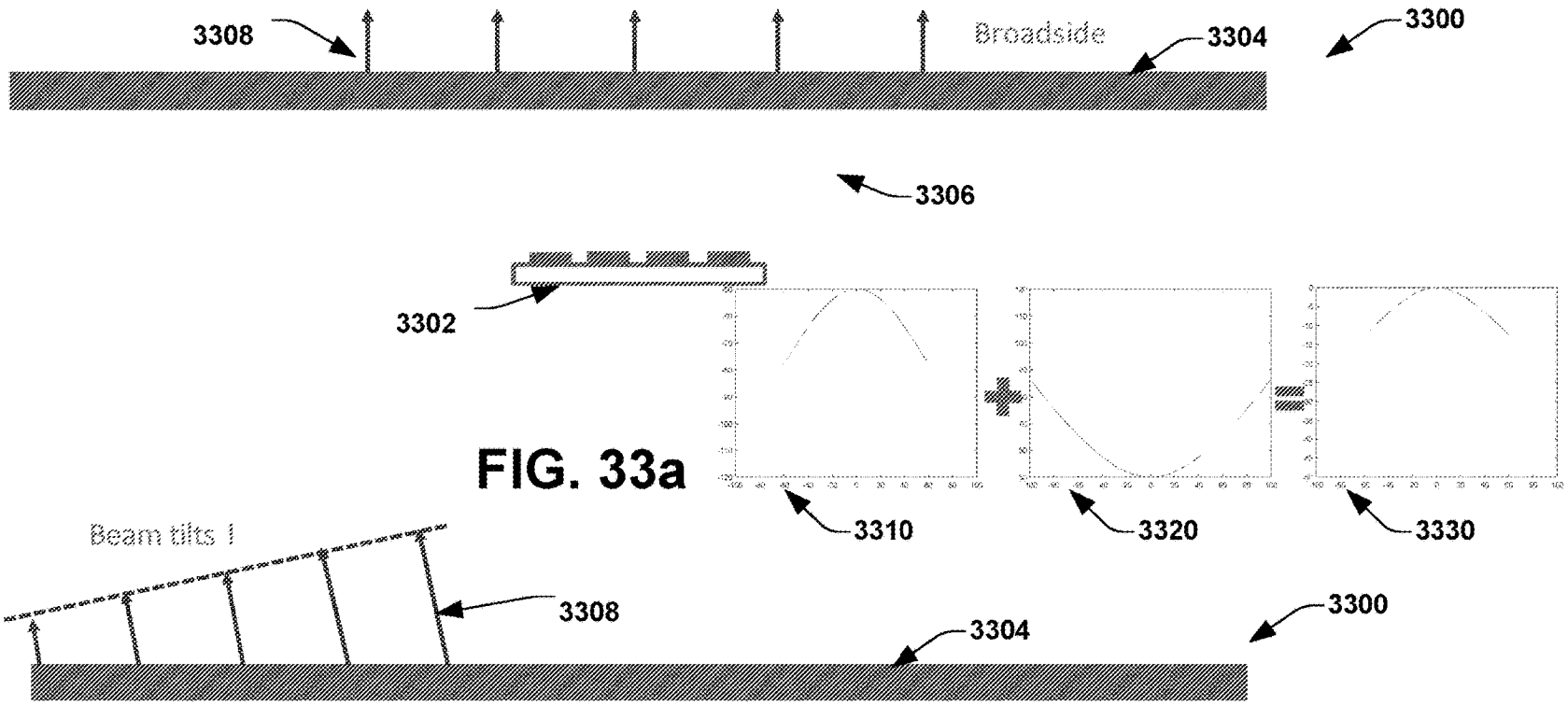
FIG. 33*a* and FIG. 33*b* illustrates an example implementation of a lens antenna system that supports 2D beam steering, according to one embodiment of the disclosure.
Figure 33B:
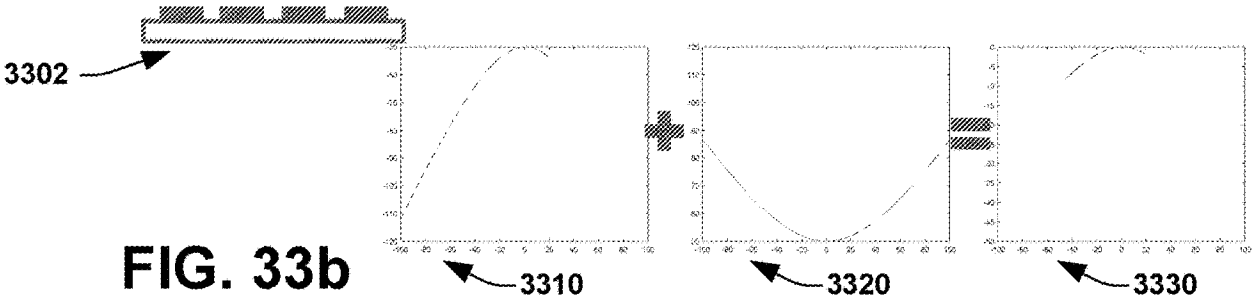

FIG. 33*a* and FIG. 33*b* illustrates an example implementation of a lens antenna system 3300 that supports 2D beam steering, according to one embodiment of the disclosure. In some embodiments, the lens antenna system 3300 is similar to the lens antenna system 3000 in FIG. 30 and is presented herein to clearly illustrate the 2D beam steering capability associated with the lens, according to one embodiment of the disclosure. The lens antenna system 3300 comprises an antenna source circuit 3302 and a lens 3304. In this embodiment, the antenna source circuit 3302 comprises a phased array antenna (PAA) circuit and the lens 3304 comprises a planar lens. However, in other embodiments, the antenna source circuit 3302 and the lens 3304 may be implemented differently. In some embodiments, the antenna source circuit 3302 is configured to provide an antenna source beam 3306 to the lens 3304. In some embodiments, the lens 3304 is configured to receive the antenna source beam 3306 and provide an output beam 3308, based on the received antenna source beam 3306.

In some embodiments, the antenna source beam 3306 comprises a phase delay profile 3310 associated therewith. In some embodiments, x-axis of the phase delay profile 3310 illustrates the different locations on the lens 3304 and the y-axis illustrates the phase delay of the antenna source beam 3306 at the different locations on the lens 3304. In some embodiments, the phase delay profile 3310 is determined based on a predefined location of the antenna source circuit 3304 and the lens 3302 with respect to one another. In some embodiments, the lens 3304 is configured to provide a phase compensation to the received antenna source beam 3306, in accordance with a phase compensation profile 3320 associated with the lens 3304, prior to providing the output beam 3308. In some embodiments, the phase compensation profile 3320 associated with the lens 3304 defines a phase compensation provided by the lens 3304 to the received antenna source beam 3306 at the different locations of the lens 3304. In some embodiments, the phase compensation profile 3320 of the lens 3304 is configured in a way that the lens 3304 provides 2-dimensional (2D) beam steering. As can be seen in FIG. 33*a*, the antenna source beam 3306 towards the broadside is steered by the lens 3304 in the broadside direction, based on the phase compensation profile 3330 of the lens 3304. Further, the antenna source beam 3306 towards the left side is steered by the lens 3304 towards the left side, based on the phase compensation profile 3330 of the lens 3304, thereby providing 2D beam steering.

In some embodiments, the phase compensation profile 3320 of the lens 3304 is configured in a way that the phase delay associated with the received antenna source beam 3306 at the different locations of the lens, defined by the phase delay profile 3310 of the antenna source beam 3306, is not fully compensated at the lens 3304, in order to provide the 2D beam steering. In particular, as can be seen in FIG. 33*a* and FIG. 33*b*, the phase compensation profile 3320 of the lens 3304 is configured not to be an exact inverse of the phase delay profile 3310 of the antenna source beam 3306, in order to provide less than a full compensation (or partial compensation) to the antenna source beam 3306. Further, in some embodiments, the phase compensation profile 3320 of the lens 3304 is configured in a way that a phase delay profile 3330 of the output beam 3308 resembles the phase delay profile 3310 of the input beam 3306, in order to provide the 2D beam steering. In some embodiments, a phase delay profile 3330 of the output beam 3308 that resembles the phase delay profile 3310 of the input beam 3306, enables the output beam 3308 to be steered aligned to the beam steering direction of the antenna source beam 3306.

Figure 36:
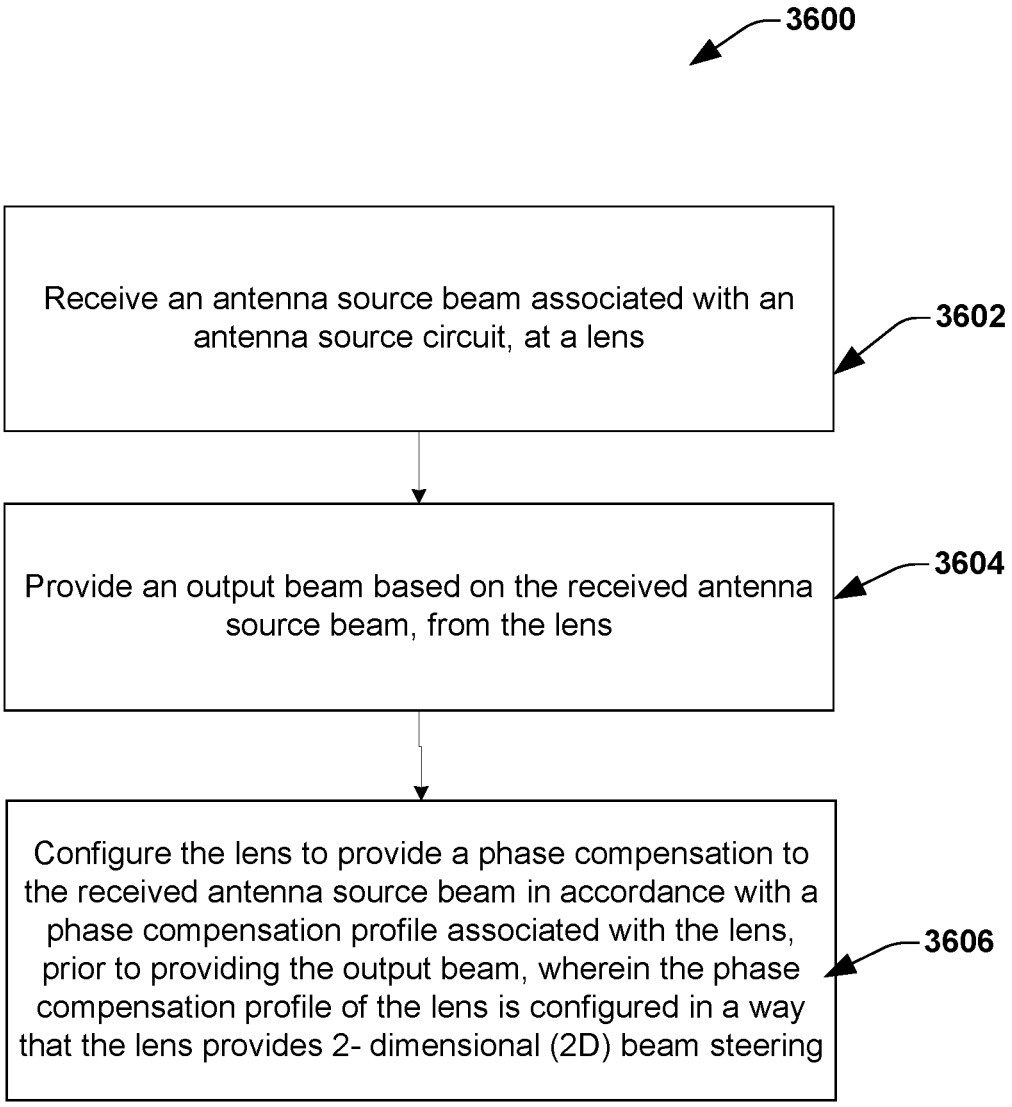
FIG. 36 illustrates a flow chart of a method for an exemplary lens antenna system that supports 2D beam steering, according to one embodiment of the disclosure.

FIG. 36 illustrates a flow chart of a method 3600 for an exemplary lens antenna system that supports 2D beam steering, according to one embodiment of the disclosure. The method 3600 is explained herein with reference to the lens antenna system 3000 in FIG. 30. However, the method 3600 is equally applicable to the lens antenna system 2900 in FIG. 29 and the lens antenna system 3300 in FIGS. 33*a-b*. At 3602, an antenna source beam (e.g., the antenna source beam 3006 in FIG. 30) associated with an antenna source circuit (e.g., the antenna source circuit 3002 in FIG. 30) is received at a lens (e.g., the planar lens 3004 in FIG. 30). At 3604, an output beam (e.g., the output beam 3008 in FIG. 30) based on the received antenna source beam is provided from the lens. In some embodiments, the output beam has higher power compared to the received antenna source beam. At 3606, the lens is to provide a phase compensation to the received antenna source beam in accordance with a phase compensation profile (e.g., the phase compensation profile 3020 in FIG. 30) associated with the lens, prior to providing the output beam.

In some embodiments, the phase compensation profile of the lens is configured in a way that the lens provides 2-dimensional (2D) beam steering. In other words, the lens steers the output beam, in accordance with the beam steering direction of the received antenna source beam. In some embodiments, the phase compensation profile of the lens is configured in a way that the phase delay associated with the received antenna source beam 3306 at the different locations of the lens, defined by the phase delay profile of the antenna source beam, is not fully compensated at the lens, in order to provide the 2D beam steering. Further, in some embodiments, the phase compensation profile of the lens is configured in a way that a phase delay profile of the output beam resembles the phase delay profile of the input beam, in order to provide the 2D beam steering, as explained above with respect to FIG. 33*a* and FIG. 33*b*.

While the methods are illustrated and described above as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the disclosure herein. Also, one or more of the acts depicted herein may be carried out in one or more separate acts and/or phases.

While the apparatus has been illustrated and described with respect to one or more implementations, alterations and/or modifications may be made to the illustrated examples without departing from the spirit and scope of the appended claims. In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention.

In particular regard to the various functions performed by the above described components (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the disclosure. In addition, while a particular feature may have been disclosed with respect to only one of several implementations, such feature may be combined with one or more other features of the other implementations as may be desired and advantageous for any given or particular application.

While the invention has been illustrated, and described with respect to one or more implementations, alterations and/or modifications may be made to the illustrated examples without departing from the spirit and scope of the appended claims. In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention.

Examples can include subject matter such as a method, means for performing acts or blocks of the method, at least one machine-readable medium including instructions that, when performed by a machine cause the machine to perform acts of the method or of an apparatus or system for concurrent communication using multiple communication technologies according to embodiments and examples described herein.

Example 1 is a lens antenna system, comprising a hybrid focal source antenna circuit configured to generate a source antenna beam, the hybrid focal source antenna circuit comprising a set of antenna elements coupled to one another, the set of antenna elements comprising a first antenna element configured to be excited in a first spherical mode; and a second antenna element configured to be excited in a second, different, spherical mode; wherein the first spherical mode and the second spherical mode are co-polarized.

Example 2 is a lens antenna system, including the subject matter of example 1, wherein the set of antenna elements further comprising one or more antenna elements configured to be excited in one or more respective spherical modes, wherein the one or more spherical modes are co-polarized with respect to the first spherical mode and the second spherical mode.

Example 3 is a lens antenna system, including the subject matter of examples 1-2, including or omitting elements, wherein the one or more spherical modes comprises one or more different spherical modes and the one or more spherical modes are different from the first spherical mode and the second spherical mode.

Example 4 is a lens antenna system, including the subject matter of examples 1-3, including or omitting elements, wherein the first spherical mode comprises a fundamental spherical mode and the second spherical mode comprises a higher order spherical mode.

Example 5 is a lens antenna system, including the subject matter of examples 1-4, including or omitting elements, wherein the first spherical mode and the second spherical mode comprise transverse magnetic (TM) modes.

Example 6 is a lens antenna system, including the subject matter of examples 1-5, including or omitting elements, wherein the first spherical mode and the second spherical mode comprise transverse electric (TE) modes.

Example 7 is a lens antenna system, including the subject matter of examples 1-6, including or omitting elements, wherein the first antenna element and the second antenna element are fed from a single input.

Example 8 is a lens antenna system, including the subject matter of examples 1-7, including or omitting elements, wherein the first antenna element and the second antenna element are fed separately from 2 separate balanced inputs.

Example 9 is a lens antenna system, including the subject matter of examples 1-8, including or omitting elements, wherein the first antenna element and the second antenna element are excited simultaneously.

Example 10 is a lens antenna system, including the subject matter of examples 1-9, including or omitting elements, wherein the first antenna element and the second antenna element are excited separately.

Example 11 is a lens antenna system, including the subject matter of examples 1-10, including or omitting elements, further comprising a lens configured to shape the source antenna beam associated with the hybrid focal source antenna circuit, in order to provide an output antenna beam.

Example 12 is a lens antenna system, including the subject matter of examples 1-11, including or omitting elements, wherein the lens comprises one of a zoned Luneburg lens, a sphere air gap (SAG) lens, a disk lens, a spherical perforated Luneburg lens and a spike lens.

Example 13 is lens antenna system, comprising a hybrid focal source antenna circuit configured to generate a source antenna beam, the hybrid focal source antenna circuit comprising a set of antenna elements coupled to one another, the set of antenna elements comprising a first antenna element configured to be excited in a first spherical mode; and a second antenna element configured to be excited in a second, different, spherical mode; wherein the first spherical mode and the second spherical mode are co-polarized; and a lens configured to shape the source antenna beam associated with the hybrid focal source antenna circuit, in order to provide an output antenna beam.

Example 14 is a lens antenna system, including the subject matter of example 13, wherein the set of antenna elements further comprising one or more antenna elements configured to be excited in one or more respective spherical modes, wherein the one or more spherical modes are co-polarized with respect to the first spherical mode and the second spherical mode.

Example 15 is a lens antenna system, including the subject matter of examples 13-14, including or omitting elements, wherein the one or more spherical modes comprises one or more different spherical modes and the one or more spherical modes are different from the first spherical mode and the second spherical mode.

Example 16 is a lens antenna system, including the subject matter of examples 13-15, including or omitting elements, wherein the first spherical mode comprises a fundamental spherical mode and the second spherical mode comprises a higher order spherical mode.

Example 17 is a lens antenna system, including the subject matter of examples 13-16, including or omitting elements, wherein the first spherical mode and the second spherical mode comprise transverse magnetic (TM) modes.

Example 18 is a lens antenna system, including the subject matter of examples 13-17, including or omitting elements, wherein the first spherical mode and the second spherical mode comprise transverse electric (TE) modes.

Example 19 is a lens antenna system, including the subject matter of examples 13-18, including or omitting elements, wherein the lens comprises one of a zoned Luneburg lens, a sphere air gap (SAG) lens, a disk lens, a spherical perforated Luneburg lens and a spike lens.

Example 20 is a method for a lens antenna system, comprising providing a hybrid focal source antenna circuit comprising a set of antenna elements coupled to one another, the set of antenna elements comprising a first antenna element and a second, different, antenna element; configuring the first antenna element to be excited in a first spherical mode; and configuring the second antenna element to be excited in a second, different, spherical mode, wherein the first spherical mode and the second spherical mode are co-polarized.

Example 21 is a method, including the subject matter of example 20, wherein the set of antenna elements further comprising one or more antenna elements configured to be excited in one or more respective spherical modes, wherein the one or more spherical modes are co-polarized with respect to the first spherical mode and the second spherical mode.

Example 22 is a method, including the subject matter of examples 20-21, including or omitting elements, wherein the one or more spherical modes comprises one or more different spherical modes and the one or more spherical modes are different from the first spherical mode and the second spherical mode.

Example 23 is a method, including the subject matter of examples 20-22, including or omitting elements, wherein the first spherical mode comprises a fundamental spherical mode and the second spherical mode comprises a higher order spherical mode.

Example 24 is a cascaded lens system associated with a lens antenna system, comprising a focusing lens configured to receive a collimated beam associated with a source antenna circuit and focus the collimated beam, in order to convert the collimated beam from spatial domain to spatial frequency domain, thereby forming a focused beam associated with the focusing lens; and a collimation lens configured to couple to the focused beam and collimate a select spatial frequency component associated with the focused beam, thereby forming a real collimated beam.

Example 25 is a cascaded lens system, including the subject matter of example 24, further comprising a quasi-collimated lens configured to receive a source antenna radiation associated with the source antenna circuit and collimate the source antenna radiation to form the collimated beam associated with the source antenna circuit.

Example 26 is a cascaded lens system, including the subject matter of examples 24-25, including or omitting elements, further comprising a spatial filter plate located between the focusing lens and the collimation lens, and configured to filter out unwanted spatial frequency components associated with the focused beam, thereby providing the select spatial frequency component associated with the focused beam to the collimation lens.

Example 27 is a cascaded lens system, including the subject matter of examples 24-26, including or omitting elements, wherein a distance of the collimation lens from the focusing lens or a size of the collimation lens is adjusted, in order to filter out unwanted spatial frequency components associated with the focused beam, thereby enabling the collimation lens to collimate the select spatial frequency component associated with the focused beam.

Example 28 is a cascaded lens system, including the subject matter of examples 24-27, including or omitting elements, wherein the select spatial frequency component comprises a fundamental spatial frequency component.

Example 29 is a cascaded lens system, including the subject matter of examples 24-28, including or omitting elements, wherein the select spatial frequency component comprises one or more spatial frequency components.

Example 30 is a cascaded lens system, including the subject matter of examples 24-29, including or omitting elements, wherein the quasi collimated lens and the focusing lens are integrated together.

Example 31 is a cascaded lens system associated with a lens antenna system, comprising a quasi-collimated lens configured to receive a source antenna radiation associated with a source antenna circuit and collimate the source antenna radiation to form a collimated beam; a focusing lens configured to receive the collimated beam and focus the collimated beam, in order to convert the collimated beam from spatial domain to spatial frequency domain, thereby forming a focused beam associated with the focusing lens; and a collimation lens configured to couple to the focused beam and collimate a select spatial frequency component associated with the focused beam, thereby forming a real collimated beam.

Example 32 is a cascaded lens system, including the subject matter of example 31, further comprising a spatial filter plate located between the focusing lens and the collimation lens, and configured to filter out unwanted spatial frequency components associated with the focused beam, thereby providing the select spatial frequency component associated with the focused beam to the collimation lens.

Example 33 is a cascaded lens system, including the subject matter of examples 31-32, including or omitting elements, wherein a distance of the collimation lens from the focusing lens or a size of the collimation lens is adjusted, in order to filter out unwanted spatial frequency components associated with the focused beam, thereby enabling the collimation lens to collimate the select spatial frequency component associated with the focused beam.

Example 34 is a cascaded lens system, including the subject matter of examples 31-33, including or omitting elements, wherein the select spatial frequency component comprises a fundamental spatial frequency component.

Example 35 is a cascaded lens system, including the subject matter of examples 31-34, including or omitting elements, wherein the select spatial frequency component comprises one or more spatial frequency components.

Example 36 is a cascaded lens system, including the subject matter of examples 31-35, including or omitting elements, wherein the quasi collimated lens and the focusing lens are integrated together.

Example 37 is a method for a cascaded lens system associated with a lens antenna system, comprising receiving a collimated beam associated with an antenna source circuit at a focusing lens and focusing the collimated beam, in order to convert the collimated beam from spatial domain to spatial frequency domain, thereby forming a focused beam associated with the focusing lens; and receiving the focused beam at a collimated lens and collimating a select spatial frequency component associated with the focused beam, thereby forming a real collimated beam.

Example 38 is a method, including the subject matter of example 37, further comprising receiving a source antenna radiation associated with the source antenna circuit at a quasi-collimated lens and collimate the source antenna radiation to form the collimated beam associated with the source antenna circuit.

Example 39 is a method, including the subject matter of examples 37-38, including or omitting elements, further comprising filtering out unwanted spatial frequency components associated with the focused beam using a spatial filter plate located between the focusing lens and the collimation lens, thereby providing the select spatial frequency component associated with the focused beam to the collimation lens.

Example 40 is a method, including the subject matter of examples 37-39, including or omitting elements, further comprising filtering out unwanted spatial frequency components associated with the focused beam based on adjusting a distance of the collimation lens from the focusing lens or a size of the collimation lens, thereby enabling the collimation lens to collimate the select spatial frequency component associated with the focused beam.

Example 41 is a method, including the subject matter of examples 37-40, including or omitting elements, wherein the select spatial frequency component comprises a fundamental spatial frequency component.

Example 42 is a method, including the subject matter of examples 37-41, including or omitting elements, wherein the select spatial frequency component comprises one or more spatial frequency components.

Example 43 is a lens antenna system, comprising a waveguide array comprising a set of waveguides, wherein each of the set of waveguides is configured to convey electromagnetic waves associated with a communication circuit; and a lens coupled with the set of waveguides and configured to receive the electromagnetic waves associated with one or more waveguides of the set of waveguides, in order to provide one or more output antenna beams.

Example 44 is a lens antenna system, including the subject matter of example 43, wherein the set of waveguides are directly connected to the lens.

Example 45 is a lens antenna system, including the subject matter of examples 43-44, including or omitting elements, wherein the set of waveguides comprises a set of dielectric waveguides, respectively made of a dielectric material.

Example 46 is a lens antenna system, including the subject matter of examples 43-45, including or omitting elements, wherein the set of dielectric waveguides comprises a set of dielectric rods, respectively.

Example 47 is a lens antenna system, including the subject matter of examples 43-46, including or omitting elements, wherein each of the set of waveguides comprises a uniform cross-section.

Example 48 is a lens antenna system, including the subject matter of examples 43-47, including or omitting elements, wherein each of the set of waveguides comprises a tapered cross-section, with the tapered end coupled to the lens.

Example 49 is a lens antenna system, including the subject matter of examples 43-48, including or omitting elements, wherein the set of waveguides are arranged in the azimuth plane or the elevation plane with respect to the lens.

Example 50 is a lens antenna system, including the subject matter of examples 43-49, including or omitting elements, wherein the set of waveguides are arranged in both the azimuth plane and the elevation plane with respect to the lens.

Example 51 is a lens antenna system, including the subject matter of examples 43-50, including or omitting elements, wherein the lens comprises a perforated structure, wherein the perforations have a predefined symmetry associated therewith.

Example 52 is a lens antenna system, including the subject matter of examples 43-51, including or omitting elements, wherein the refractive index of each waveguide of the set of waveguides varies both radially and axially.

Example 53 is a method for a lens antenna system, comprising conveying electromagnetic waves associated with a communication circuit using one or more waveguides of a set of waveguides associated with a waveguide array; and receiving the electromagnetic waves associated with the one or more waveguides of the set of waveguides, at a lens coupled to the set of waveguides, in order to form one or more output antenna beams.

Example 54 is a method, including the subject matter of example 53, wherein the set of waveguides are directly connected to the lens.

Example 55 is a method, including the subject matter of examples 53-54, including or omitting elements, wherein the set of waveguides comprises a set of dielectric waveguides, respectively made of a dielectric material.

Example 56 is a method, including the subject matter of examples 53-55, including or omitting elements, wherein the set of dielectric waveguides comprises a set of dielectric rods, respectively.

Example 57 is a method, including the subject matter of examples 53-56, including or omitting elements, wherein each of the set of waveguides comprises a uniform cross-section.

Example 58 is a method, including the subject matter of examples 53-57, including or omitting elements, wherein each of the set of waveguides comprises a tapered cross-section, with the tapered end coupled to the lens.

Example 59 is a method, including the subject matter of examples 53-58, including or omitting elements, wherein the set of waveguides are arranged in the azimuth plane or the elevation plane with respect to the lens.

Example 60 is a method, including the subject matter of examples 53-59, including or omitting elements, wherein the set of waveguides are arranged in both the azimuth plane and the elevation plane with respect to the lens.

Example 61 is a method, including the subject matter of examples 53-60, including or omitting elements, wherein the lens comprises a perforated structure, wherein the perforations have a predefined symmetry associated therewith.

Example 62 is a method, including the subject matter of examples 53-61, including or omitting elements, wherein the refractive index of each waveguide of the set of waveguides varies both radially and axially.

Example 63 is a lens antenna system, comprising a lens configured to receive an antenna source beam associated with an antenna source circuit; and provide an output beam based on the received antenna source beam; wherein the lens is configured to provide a phase compensation to the received antenna source beam in accordance with a phase compensation profile associated with the lens, prior to providing the output beam; and wherein the phase compensation profile of the lens is configured in a way that the lens provides 2-dimensional (2D) beam steering.

Example 64 is a lens antenna system, including the subject matter of example 63, wherein the lens comprises a planar lens.

Example 65 is a lens antenna system, including the subject matter of examples 63-64, including or omitting elements, wherein the phase compensation profile of the lens is configured in a way that a phase delay associated with the received antenna source beam at different locations of the lens, defined by a phase delay profile of the antenna source beam, is not fully compensated at the lens, in order to provide the 2D beam steering.

Example 66 is a lens antenna system, including the subject matter of examples 63-65, including or omitting elements, wherein the phase compensation profile of the lens is configured in a way that a phase delay profile of the output beam resembles the phase delay profile of the input beam, in order to provide the 2D beam steering.

Example 67 is a lens antenna system, including the subject matter of examples 63-66, including or omitting elements, wherein a design or geometry of the lens is modified, in order to configure the phase compensation profile of the lens.

Example 68 is a lens antenna system, including the subject matter of examples 63-67, including or omitting elements, wherein the lens comprises a plurality of unit cells, and wherein a geometry of a set of unit cells of the plurality of unit cells is modified, in order to configure the phase compensation profile of the lens.

Example 69 is a lens antenna system, including the subject matter of examples 63-68, including or omitting elements, wherein the lens is separated from the antenna source circuit by a distance.

Example 70 is a method for a lens antenna system, comprising receiving an antenna source beam associated with an antenna source circuit, at a lens; providing an output beam based on the received antenna source beam, from the lens; and configuring the lens to provide a phase compensation to the received antenna source beam in accordance with a phase compensation profile associated with the lens, prior to providing the output beam, wherein the phase compensation profile of the lens is configured in a way that the lens provides 2-dimensional (2D) beam steering.

Example 71 is a method, including the subject matter of example 70, wherein the lens comprises a planar lens.

Example 72 is a method, including the subject matter of examples 70-71, including or omitting elements, wherein the phase compensation profile of the lens is configured in a way that a phase delay associated with the received antenna source beam at different locations of the lens, defined by a phase delay profile of the antenna source beam, is not fully compensated at the lens, in order to provide the 2D beam steering.

Example 73 is a method, including the subject matter of examples 70-72, including or omitting elements, wherein the phase compensation profile of the lens is configured in a way that a phase delay profile of the output beam resembles the phase delay profile of the input beam, in order to provide the 2D beam steering.

Example 74 is a method, including the subject matter of examples 70-73, including or omitting elements, wherein a design or geometry of the lens is modified, in order to configure the phase compensation profile of the lens.

Example 75 is a method, including the subject matter of examples 70-74, including or omitting elements, wherein the lens comprises a plurality of unit cells, and wherein a geometry of a set of unit cells of the plurality of unit cells is modified, in order to configure the phase compensation profile of the lens.

Example 76 is a method, including the subject matter of examples 70-75, including or omitting elements, wherein the lens is separated from the antenna source circuit by a distance.

Various illustrative logics, logical blocks, modules, and circuits described in connection with aspects disclosed herein can be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor can be a microprocessor, but, in the alternative, processor can be any conventional processor, controller, microcontroller, or state machine.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

The invention claimed is:

1. A lens antenna system, comprising:

an array comprising a set of electromagnetic radiation couplers;

a switching network configured to cause each electromagnetic radiation coupler from among the set of electromagnetic radiation couplers to selectively couple electromagnetic waves associated with a communication circuit; and a lens coupled to the set of electromagnetic radiation couplers, the lens being configured to receive electromagnetic waves generated by the set of electromagnetic radiation couplers to generate one or more antenna beams.

2. The lens antenna system of claim 1, wherein the set of electromagnetic radiation couplers are arranged in an azimuth plane with respect to the lens.

3. The lens antenna system of claim 1, wherein each electromagnetic radiation coupler from among the set of electromagnetic radiation couplers is arranged in one of (i) an azimuth plane, or (ii) an elevation plane, with respect to the lens.

4. The lens antenna system of claim 1, wherein the set of electromagnetic radiation couplers includes a first subset of electromagnetic radiation couplers arranged in an azimuth plane with respect to the lens, and a second subset of electromagnetic radiation couplers arranged in an elevation plane with respect to the lens.

5. The lens antenna system of claim 1, wherein the lens comprises a perforated structure with symmetrically-arranged perforations.

6. The lens antenna system of claim 1, wherein the set of electromagnetic radiation couplers are directly coupled to the lens.

7. The lens antenna system of claim 1, wherein the lens is a Luneburg lens.

8. The lens antenna system of claim 1, wherein the set of electromagnetic radiation couplers comprises a set of dielectric waveguides, each electromagnetic radiation coupler from among the set of electromagnetic radiation couplers being comprised of a dielectric material.

9. The lens antenna system of claim 8, wherein each electromagnetic radiation coupler from among the set of electromagnetic radiation couplers has a uniform cross-section.

10. The lens antenna system of claim 1, wherein each electromagnetic radiation coupler from among the set of electromagnetic radiation couplers comprises a waveguide comprising a set of dielectric rods.

11. A lens antenna system, comprising:

a set of electromagnetic radiation couplers;

a switching network configured to cause each electromagnetic radiation coupler from among the set of electromagnetic radiation couplers to selectively couple electromagnetic waves associated with a communication circuit; and a lens coupled to the set of electromagnetic radiation couplers, the lens being configured to receive electromagnetic waves generated by the set of electromagnetic radiation couplers, wherein the set of electromagnetic radiation couplers are arranged in an azimuth plane with respect to the lens.

12. The lens antenna system of claim 11, wherein the set of electromagnetic radiation couplers are arranged in an equator of the lens.

13. The lens antenna system of claim 11, wherein the lens is configured to receive the electromagnetic waves generated by the set of electromagnetic radiation couplers to generate one or more antenna beams.

14. The lens antenna system of claim 11, wherein the set of electromagnetic radiation couplers is a first subset of electromagnetic radiation couplers from among an array of electromagnetic radiation couplers that includes the first subset of electromagnetic radiation couplers and a second subset of electromagnetic radiation couplers that are arranged in an elevation plane with respect to the lens.

15. The lens antenna system of claim 11, wherein the lens comprises a perforated structure with symmetrically-arranged perforations.

16. The lens antenna system of claim 11, wherein the set of electromagnetic radiation couplers are directly coupled to the lens.

17. The lens antenna system of claim 11, wherein the lens is a Luneburg lens.

18. The lens antenna system of claim 11, wherein the set of electromagnetic radiation couplers comprises a set of dielectric waveguides, each electromagnetic radiation coupler from among the set of electromagnetic radiation couplers being comprised of a dielectric material.

19. The lens antenna system of claim 18, wherein each electromagnetic radiation coupler from among the set of electromagnetic radiation couplers has a uniform cross-section.

20. The lens antenna system of claim 11, wherein each electromagnetic radiation coupler from among the set of electromagnetic radiation couplers comprises a waveguide comprising a set of dielectric rods.

* * * * *